US007954602B2

(12) United States Patent
Stanislao

(10) Patent No.: US 7,954,602 B2
(45) Date of Patent: Jun. 7, 2011

(54) LIFT APPARATUS WITH TELESCOPING PLATFORM ATTACHMENT AND METHOD

(76) Inventor: Joseph Stanislao, Bozeman, MT (US)

( * ) Notice: Subject to any disclaimer, the term of this patent is extended or adjusted under 35 U.S.C. 154(b) by 576 days.

(21) Appl. No.: 11/778,169

(22) Filed: Jul. 16, 2007

(65) Prior Publication Data

US 2008/0042114 A1 Feb. 21, 2008

Related U.S. Application Data

(63) Continuation-in-part of application No. 11/288,545, filed on Nov. 28, 2005, now Pat. No. 7,325,654.

(51) Int. Cl.
*B66B 9/08* (2006.01)
*B66F 9/14* (2006.01)

(52) U.S. Cl. ..... 187/201; 187/200; 187/212; 187/240; 414/522; 414/659; 414/921

(58) Field of Classification Search ..... 187/200, 187/202, 212, 270, 201, 203, 240; 414/480, 414/630, 631, 643, 785, 921, 522, 659; 14/42, 14/43, 71.3; *B66B 9/04, 9/08; E01D 1/00; B66F 9/14, 7/24*

See application file for complete search history.

(56) References Cited

U.S. PATENT DOCUMENTS

| | | | | |
|---|---|---|---|---|
| 2,091,068 A | * | 8/1937 | Girl | 414/522 |
| 2,295,934 A | * | 9/1942 | Clark | 414/522 |
| 2,497,472 A | * | 2/1950 | Sims | 187/211 |
| 2,788,137 A | * | 4/1957 | Harkness | 414/522 |
| 3,598,265 A | * | 8/1971 | Aaronson et al. | 414/661 |
| 3,809,266 A | * | 5/1974 | Salerni | 414/462 |
| 4,078,677 A | * | 3/1978 | Huggins et al. | 414/514 |
| 4,081,091 A | * | 3/1978 | Thorley | 414/545 |
| 4,176,999 A | * | 12/1979 | Thorley | 414/540 |
| 4,251,179 A | * | 2/1981 | Thorley | 414/545 |
| 4,265,586 A | | 5/1981 | Couture | |

(Continued)

FOREIGN PATENT DOCUMENTS

EP 121348 A1 * 10/1984

(Continued)

OTHER PUBLICATIONS

Saul Rodriguez, International Search Report, PCT/US07/73847, received Jan. 2, 2008.

(Continued)

*Primary Examiner* — Michael R Mansen
*Assistant Examiner* — Stefan Kruer
(74) *Attorney, Agent, or Firm* — Holland & Hart LLP

(57) ABSTRACT

A lift apparatus is disclosed. Particularly, a lift apparatus may comprise a support frame and a platform movably coupled to the support frame. Further, the platform may comprise at least one roller and a transmission connected to the at least one roller of the assembly, wherein rotation of the at least one roller causes the platform to move relative to the support frame. In another aspect of the present invention, a lift apparatus may include a telescoping platform. The present invention also contemplates a method of moving a wheelchair lift. Particularly, a wheelchair may be positioned such that at least one wheel of the wheelchair contacts a drive mechanism of a platform or a telescoping platform that are positioned at an initial position. Further, the at least one wheel of the wheelchair may be rotated to cause the platform or the telescoping platform to move relative to their initial positions.

20 Claims, 37 Drawing Sheets

U.S. PATENT DOCUMENTS 4,466,771 A * 8/1984 Thorley et al. ..... 414/787
4,531,614 A 7/1985 Naegeli
4,582,500 A * 4/1986 Hanson et al. ..... 446/423
4,636,176 A 1/1987 Capilla
4,926,973 A * 5/1990 Smith ..... 187/240
5,026,243 A * 6/1991 Dell ..... 414/401
5,044,473 A 9/1991 Gripe
5,050,708 A 9/1991 Wood
5,105,915 A 4/1992 Gary
5,164,623 A 11/1992 Shkondin
5,370,206 A 12/1994 Chao
5,439,342 A * 8/1995 Hall et al. ..... 414/545
5,499,694 A 3/1996 Dorn
5,553,990 A * 9/1996 Kytola, Sr. ..... 414/659
5,829,945 A * 11/1998 Stanley ..... 414/477
5,832,555 A * 11/1998 Saucier et al. ..... 14/71.1
5,865,593 A * 2/1999 Cohn ..... 414/546
5,901,812 A 5/1999 Meunier
6,071,064 A * 6/2000 Hackett ..... 414/545
6,105,726 A 8/2000 Taylor et al.
6,171,198 B1 1/2001 Troncoso et al.
6,345,547 B1 * 2/2002 Stoelinga et al. ..... 74/89.17
6,390,761 B1 * 5/2002 Palmer et al. ..... 414/477
6,419,050 B1 * 7/2002 Sardonico ..... 187/244
6,517,443 B1 2/2003 Villella
6,739,430 B2 5/2004 Hill
7,207,764 B1 4/2007 Snook
2006/0180399 A1 8/2006 Stanislao

FOREIGN PATENT DOCUMENTS

JP 01133885 A * 5/1989

OTHER PUBLICATIONS

Kathy Mateckl, International Search Report, PCT US05/43129, received Sep. 19, 2007.

* cited by examiner

LIFT APPARATUS WITH TELESCOPING PLATFORM ATTACHMENT AND METHOD

CROSS-REFERENCE TO RELATED APPLICATIONS

The present application is a Continuation-in-Part and claims priority to U.S. patent application Ser. No. 11/288,545, entitled LIFT APPARATUSES AND METHOD, filed Nov. 28, 2005, now allowed, which claims the benefit of U.S. Provisional Patent Application No. 60/631,745, filed Nov. 30, 2004, the disclosure of which is incorporated, in its entirety, by this reference.

FIELD OF INVENTION

The present invention relates generally to lift apparatuses and methods for facilitating mobility of wheel chair bound persons. In one application, such lift apparatuses may be operated by rotation of at least one wheel of a wheelchair. In another application, such lift apparatuses may include a telescoping platform.

BACKGROUND

Mobility may be challenging for physically-challenged people. Conventional ramps, wheel chairs, wheel chair lifts, and other types of ramps have enhanced, to some degree, mobility for physically-challenged people. Although such conventional devices have improved the mobility for physically-challenged persons, vertical mobility, for instance, inside and outside of buildings may remain difficult or impossible. Such difficulty may be exacerbated when other limitations exist, such as unavailability of elevators or electric power.

Accordingly, improved apparatuses and methods for providing enhanced mobility to physically-challenged people would be desirable and useful.

SUMMARY

There exists a need to provide a lift apparatus and telescoping platform which overcomes at least some of the above-referenced deficiencies. Accordingly, at least this and other needs have been addressed by exemplary embodiments of the lift apparatus with telescoping platform attachment and method according to the present invention. One such embodiment is directed to a lift apparatus for traversing a change in elevation (e.g., an incline or one or more steps, such as a flight of stairs) by a wheelchair-bound person. The lift apparatus may include a support frame structured to move a moveable platform in a vertical direction relative to the support frame and an attached telescoping platform adapted to extend in a lateral direction from the moveable platform. The telescoping platform may comprise a plurality of nested support plates adapted to slide laterally relative to each other through a plurality of attached channels.

In one embodiment of the present invention, the lift apparatus may further comprise at least one roller structured to contact at least one wheel of a wheelchair, wherein rotation of the at least one wheel causes the moveable platform to move in a vertical direction relative to the support frame or causes the telescoping platform to move in a lateral direction relative to the support frame.

In another exemplary embodiment of the present invention, the lift apparatus may include a clutch for selectively engaging and disengaging the vertical motion of the moveable platform and the lateral motion of the telescoping platform.

In another exemplary embodiment of the present invention, a hand crank system is provided to allow a wheelchair occupant to manually extend the telescoping ramp in a lateral direction relative to the support frame.

In another exemplary embodiment of the present invention, induction motors are provided to automate the vertical motion of the moving platform and the lateral motion of the telescoping platform.

In yet another exemplary embodiment of the present invention, one or more limit mechanisms are provided to control the vertical motion of the moveable platform. In one embodiment, a spring biasing system is provided to counteract the load created by a wheelchair and an occupant when the moveable platform moves in a vertical direction. In another embodiment, a mechanical locking assembly is provided to stabilize the moving platform when a wheelchair occupant enters or exits the lift apparatus.

Features from any of the above-mentioned embodiments may be used in combination with one another in accordance with the present invention. In addition, other features and advantages of the present invention will become apparent to those of ordinary skill in the art through consideration of the ensuing description, the accompanying drawings, and the appended claims.

BRIEF DESCRIPTION OF THE DRAWINGS

Advantages of the present invention will become apparent upon review of the following detailed description and drawings, which illustrate representations (not necessarily drawn to scale) of various aspects of the present invention, wherein.

DETAILED DESCRIPTION

Figure 1:
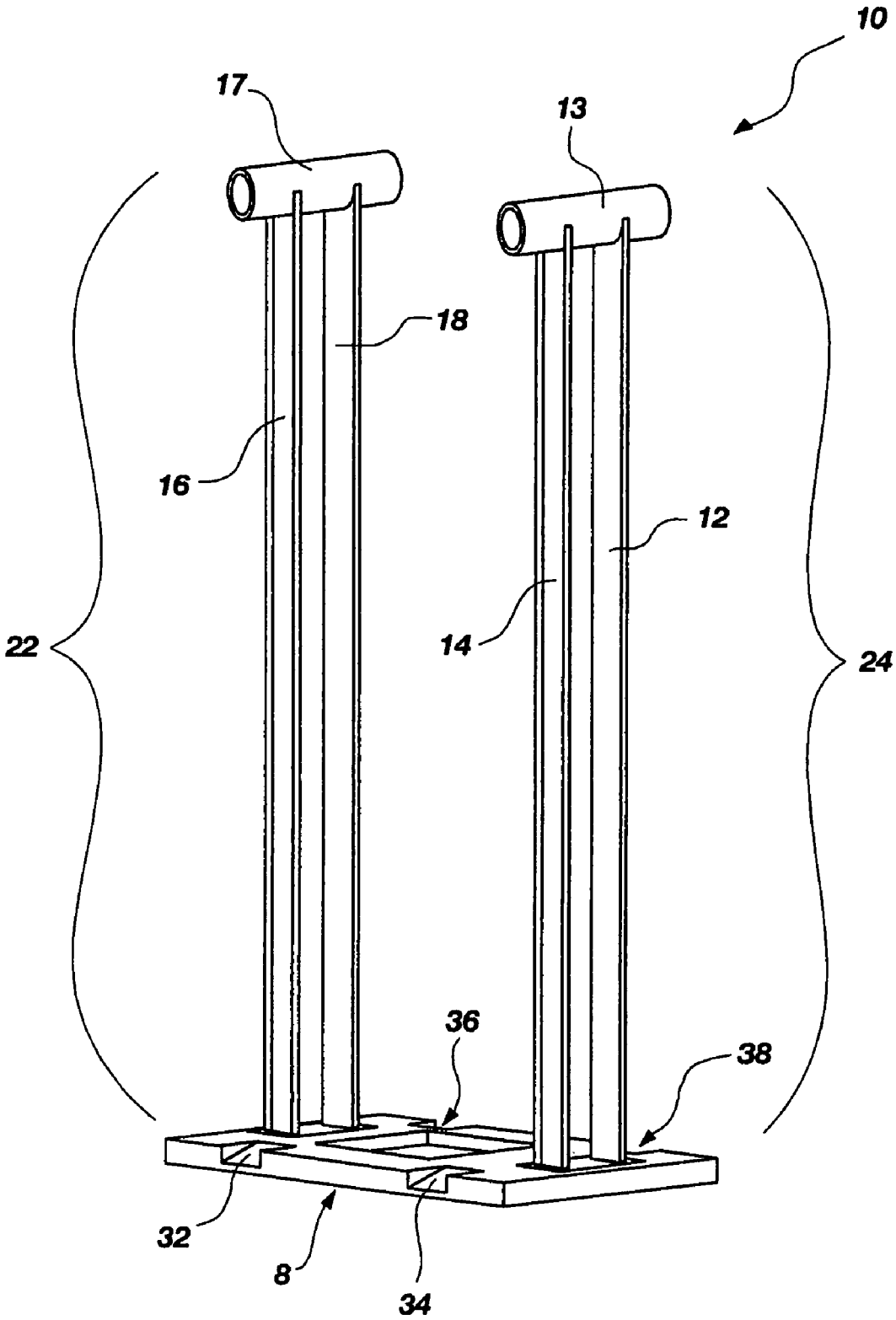
FIG. 1 shows a perspective view of one embodiment of a support frame including a first columnar assembly, a second columnar assembly, and a frame base.

Generally, the present invention relates to lift apparatuses for traversing a change in elevation (e.g., an incline or one or more steps, such as a flight of stairs) by a wheelchair-bound person. In one embodiment, a lift apparatus may include a support frame extending upwardly from a ground surface on which the lift is positioned. Such a lift apparatus may also include a moveable platform assembly, which may support the wheels of the wheelchair and which may be movably coupled to the support frame. Further, a transmission may connect the support frame and the moveable platform and may be operated to cause the moveable platform assembly to move (e.g., to raise or lower) relative to the support frame. For example, a lift apparatus may be operated by moving at least one wheel of a wheelchair or otherwise rotating at least one drive roller operably coupled to the transmission.

Thus, a moveable platform assembly may include at least one roller operably connected or coupled to a transmission. The at least one roller may be impelled or driven by at least one wheelchair wheel and may move (i.e., rotate) in response to movement (i.e., rotation) of at least one wheelchair wheel. Movement of the at least one roller may cause the transmission to move the moveable platform assembly generally vertically relative to the support frame. Generally, a transmission may comprise at least one chain, at least one sprocket, at least one gear, at least one pulley (e.g., at least one pinion pulley), at least one belt, at least one rope, at least one axle, or any combination of the foregoing, wherein the transmission is configured in a manner that allows the moveable platform assembly (in combination with a wheelchair and person supported by the moveable platform assembly) to move relative to a support frame. In one embodiment, a transmission may be structured to move the moveable platform in response to a torque applied to at least one wheelchair wheel which is substantially equal to, or less than, a torque required to move the wheelchair across a substantially horizontal surface. In another embodiment, a lift apparatus may allow a wheelchair-bound user to apply 12 pounds of force, or less, to at least one wheelchair wheel to cause the lift apparatus to move a wheelchair supported by a moveable platform.

As mentioned above, a lift apparatus according to the present invention may include a support frame. Generally, the support frame may be structured for suitable stability and strength for a selected range of positions of the moveable platform. Typically, the support frame may be structured for movement of the moveable platform in a substantially vertical direction. However, the present invention contemplates that lift apparatuses may be configured for substantially horizontal motion or along any other selected direction, without limitation. Thus, a support frame may be structured for providing suitable stability and sufficient mechanical strength to support a moveable platform coupled to the support frame for movement of the platform relative to the support frame.

In one embodiment, a support frame may include two columns or columnar assemblies extending from a base. For example, FIG. 1 shows a perspective view of a support frame 10 including a first columnar assembly 22 and a second columnar assembly 24 extending from frame base 8. Frame base 8 may optionally include ramp regions 32, 34, 36, 38 for facilitating rolling of a wheelchair or other wheeled object onto the frame base 8. More particularly, columnar assembly 22 comprises columns 16, 18 and cross-brace 17. Similarly, columnar assembly 24 includes columns 12, 14 and cross-brace 13. Columns 16, 18 may be mechanically coupled to frame base 8 and cross-brace 17 as known in the art. For example, columns 16, 18 may be welded, fastened by fastening elements, or otherwise affixed to cross-brace 17 and frame base 8. Similarly, columns 12, 14 of columnar assembly 24 may be affixed to cross-brace 13 and frame base 8 by any of the above-mentioned techniques or as otherwise known in the art. Further, it may be appreciated that columns 12, 14, 16, 18 may comprise at least one structural element, such as, for example, at least one of the following structural elements: an I-beam, a channel beam, an angle beam, a pipe, a tube, or another structural member as known in the art. In addition, frame base 8 may comprise plate or sheet material that is welded, bent, or otherwise formed, as known in the art. Accordingly, frame base 8 and columnar assemblies 22, 24 may comprise a metal (e.g., steel, aluminum, etc.), a composite (e.g., fiberglass composite, graphite composite, etc.), or any other material as known in the art. Of course, support frame 10 may comprise one or more materials and a structure intended to provide sufficient strength, desired deflection characteristics, corrosion resistance, or other properties of interest.

As mentioned above, the present invention contemplates that a moveable platform may be operably coupled to a support frame. More specifically, a moveable platform may be configured to move (e.g., slide or roll) relative to at least a portion of a support frame. For instance, bushings, wheels, or other mechanisms configured for facilitating movement between two structures may be positioned between a support frame and a moveable platform. Such mechanisms may facilitate movement and positioning of a moveable platform with respect to a support frame.

Figure 2:
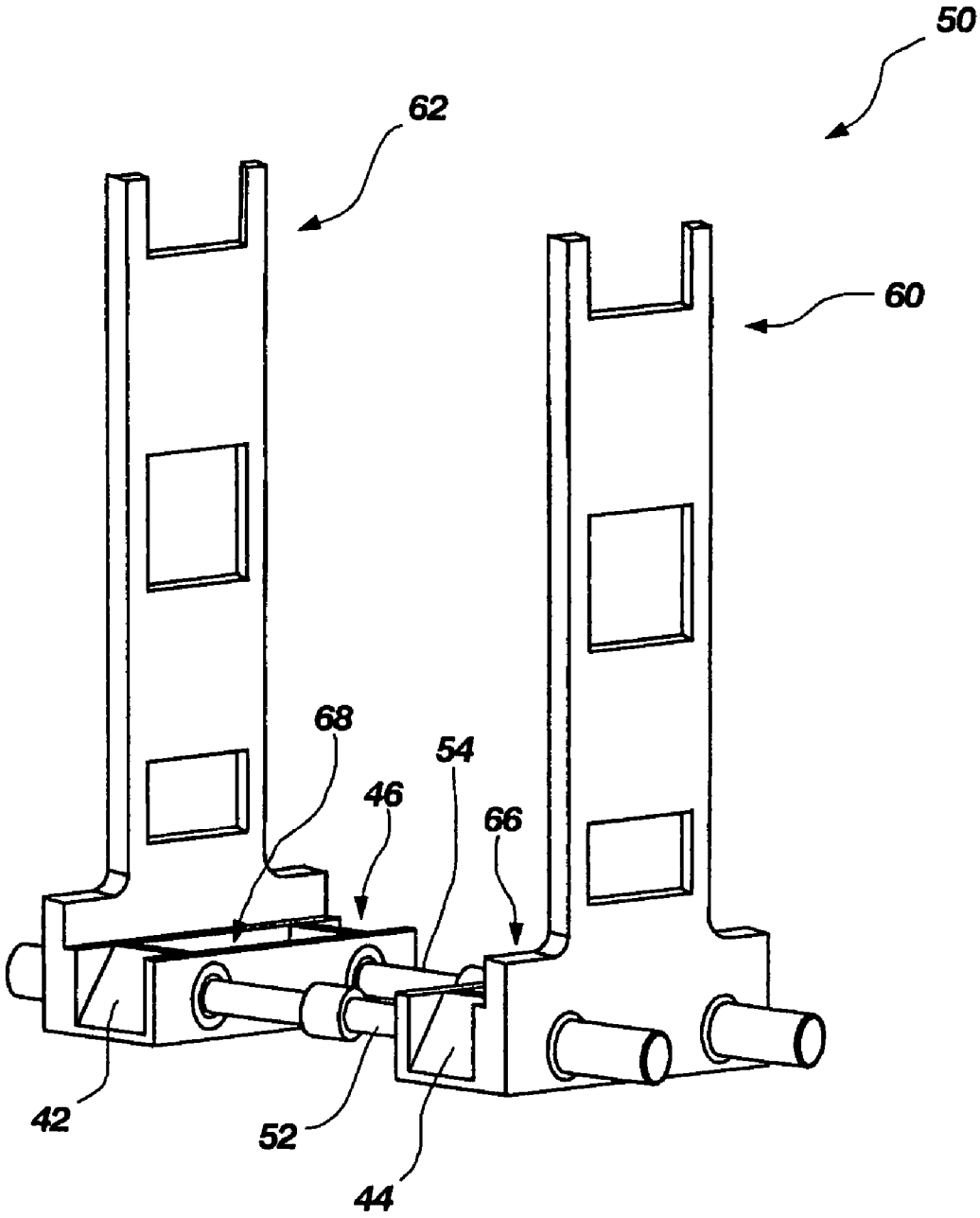
FIG. 2 shows a perspective view of one embodiment of a moveable platform including a first platform leg, a second platform leg, and two drive axles.
Figure 3:
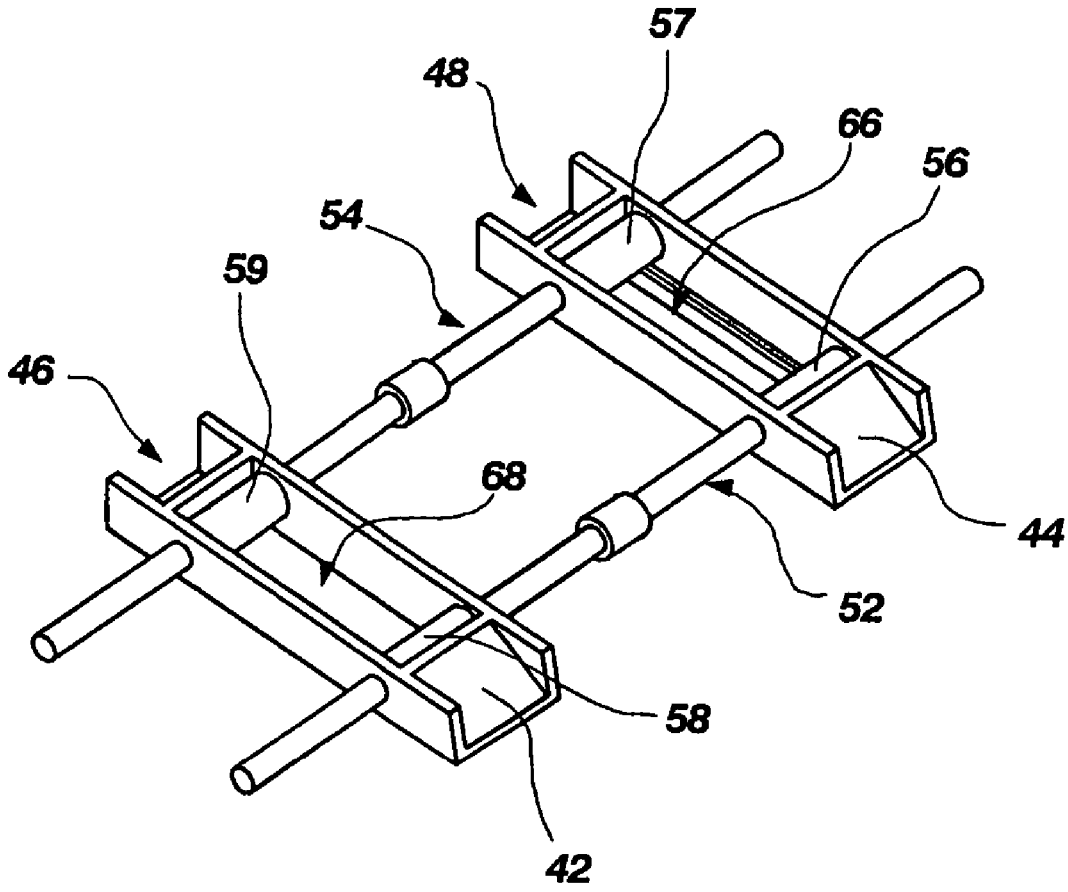
FIG. 3 shows a partial perspective view of the moveable platform shown in FIG. 2.

In one embodiment, a moveable platform may comprise two platform legs, which are positioned substantially opposite of one another and two platform axles extending through each of the support legs. For example, FIG. 2 shows a perspective view of a moveable platform 50 including support legs 60, 62 and platform axles 52, 54 extending between support legs 60, 62. In addition, FIG. 3 shows a partial, sectioned view of moveable platform 50. As shown in FIGS. 2 and 3, support legs 60, 62 may define, respectively, wheel recesses 66, 68. In addition, ramp regions 42, 44, 46, 48 may be formed by support legs 60, 62 to facilitate rolling of a wheelchair or other wheeled object over or onto platform 50. Wheel recesses 66, 68 may be sized and positioned so that wheels of a wheelchair may be positioned (e.g., by rolling over ramp regions 32, 34 of support frame 10 and ramp regions 42, 44 of platform 50) generally within wheel recesses 66, 68, respectively. Furthermore, the present invention contemplates that at least one roller may be coupled to at least one of platform axles 52, 54 and may be configured for rotating in response to contact with at least one wheelchair wheel during rotation of the at least one wheelchair wheel. As shown in FIGS. 2 and 3, optionally, moveable platform 50 may include a plurality of rollers 56, 57, 58, 59 that are positioned generally within wheel recesses 66, 68, respectively. Thus, rollers 56, 57 may be configured to support one wheel of a wheelchair and rollers 58, 59 may be configured to support the other wheel of a wheelchair. Further, rotation of both wheels of a wheelchair may cause rollers 56, 57, 58, 59 to rotate.

Of course, it should be appreciated that a single roller coupled to a platform axle may be rotated in response to rotation of a rear wheel of a wheelchair, if desired, without limitation. Put another way, the present invention contemplates that a moveable platform may include at least one roller that is operably coupled to a transmission, as discussed below, without limitation. For example, accordingly, it should be understood that platform axle 54 of moveable platform 50 may be omitted; accordingly, in another embodiment, platform axle 52 may include only roller 56, which is operably coupled to a transmission. Of course, if each wheel of a wheelchair may be independently rotated, only the wheel interacting with the roller 56 may be rotated. Otherwise, if both drive wheels of a wheelchair are rotated simultaneously, the wheel that is not interacting with the roller may be supported by a rolling or sliding mechanism or the axle of the wheelchair wheel may be supported to avoid contact of the noninteracting wheel with the moveable platform.

As mentioned above, the present invention contemplates that a transmission may mechanically connect or couple a moveable platform to a support frame. Such a transmission may include any mechanical components known in the art that may be useful for causing a moveable platform assembly to move relative to a support frame. As mentioned above, a transmission may comprise at least one chain, at least one sprocket, at least one gear, at least one pulley, at least one belt, at least one rope, at least one axle, or any combination of the foregoing, without limitation. It may be understood that such a transmission may generate a mechanical advantage. For example, a transmission may be configured to generate a force for moving the moveable platform of at least about 50 times (i.e., a mechanical advantage of at least about 50) a force applied to at least one roller of the moveable platform. Such a configuration may provide sufficient force for substantially vertically lifting (e.g., against an earthly gravitational force) a platform, a wheelchair, and a wheelchair occupant with respect to a support frame.

Figure 4:
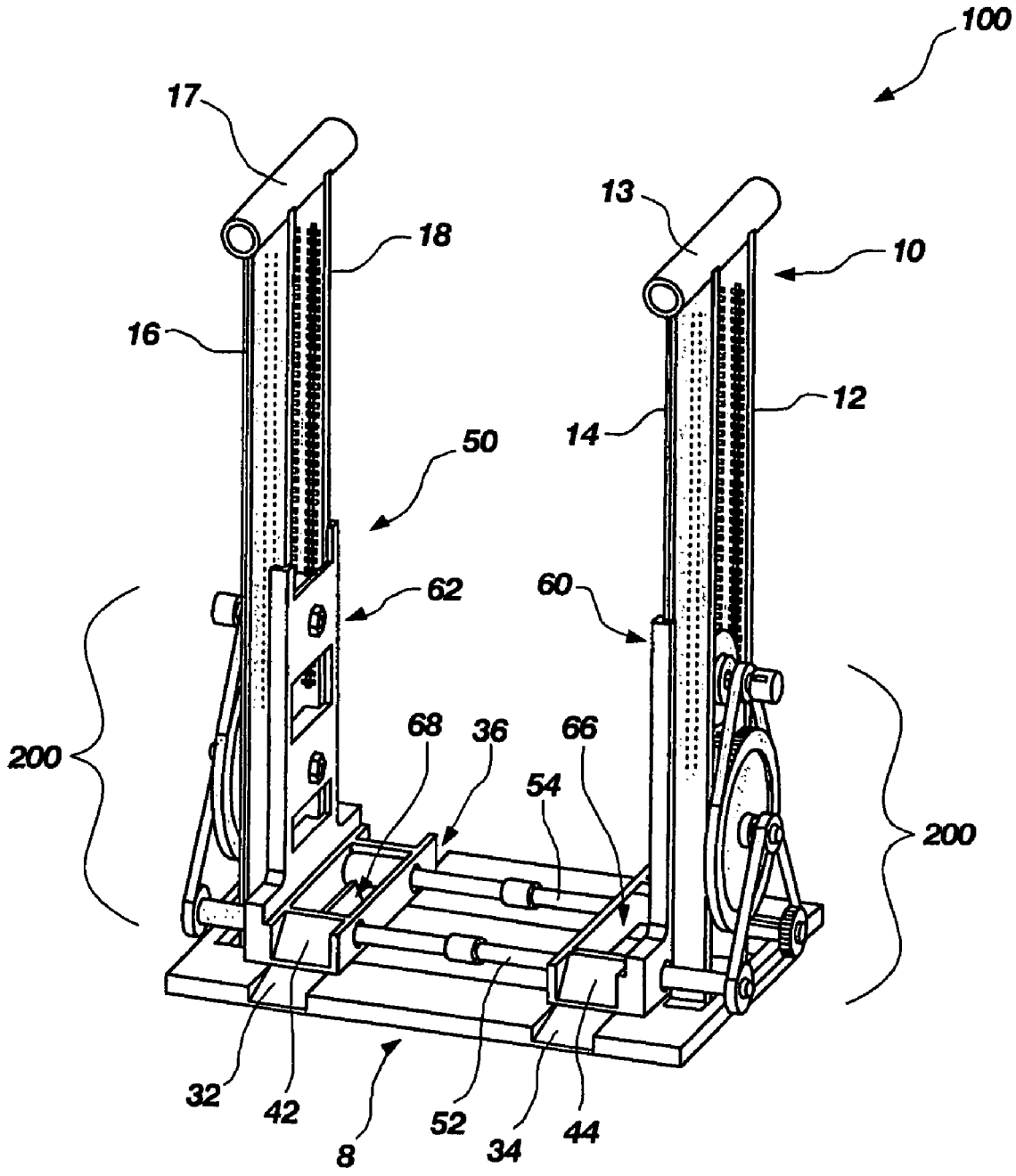
FIG. 4 shows a perspective view of a lift apparatus including a support frame as shown in FIG. 1 and a moveable platform as shown in FIGS. 2 and 3.
Figure 5:
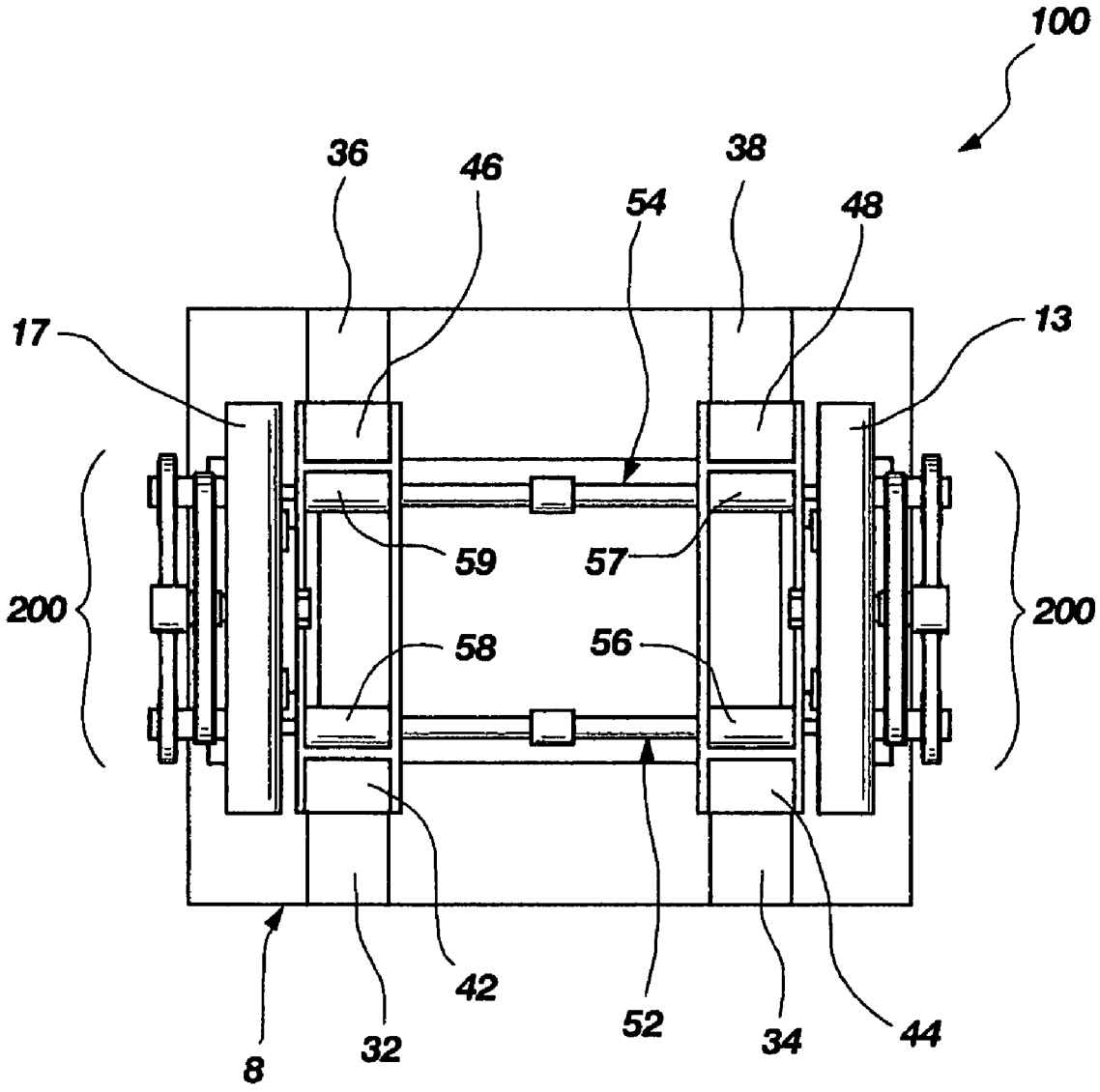
FIG. 5 shows a top elevation view of the lift apparatus shown in FIG. 4.

FIGS. 4 and 5 show a perspective view and a top elevation view of a lift apparatus 100 including a platform 50 coupled to a support frame 10. Further, a transmission couples platform 50 to support frame 10. More particularly, each of support legs 60, 62 may include a substantially identical transmission 200. Put another way, a transmission may comprise two sub-assemblies, wherein the two sub-assemblies (e.g., separate transmissions 200, respectively) are coupled to each of the columnar assembly 22 and columnar assembly 24, respectively. Such a configuration may provide a relatively stable, robust, and balanced transmission for coupling platform 50 to support frame 10 to form lift apparatus 100.

Figure 6:
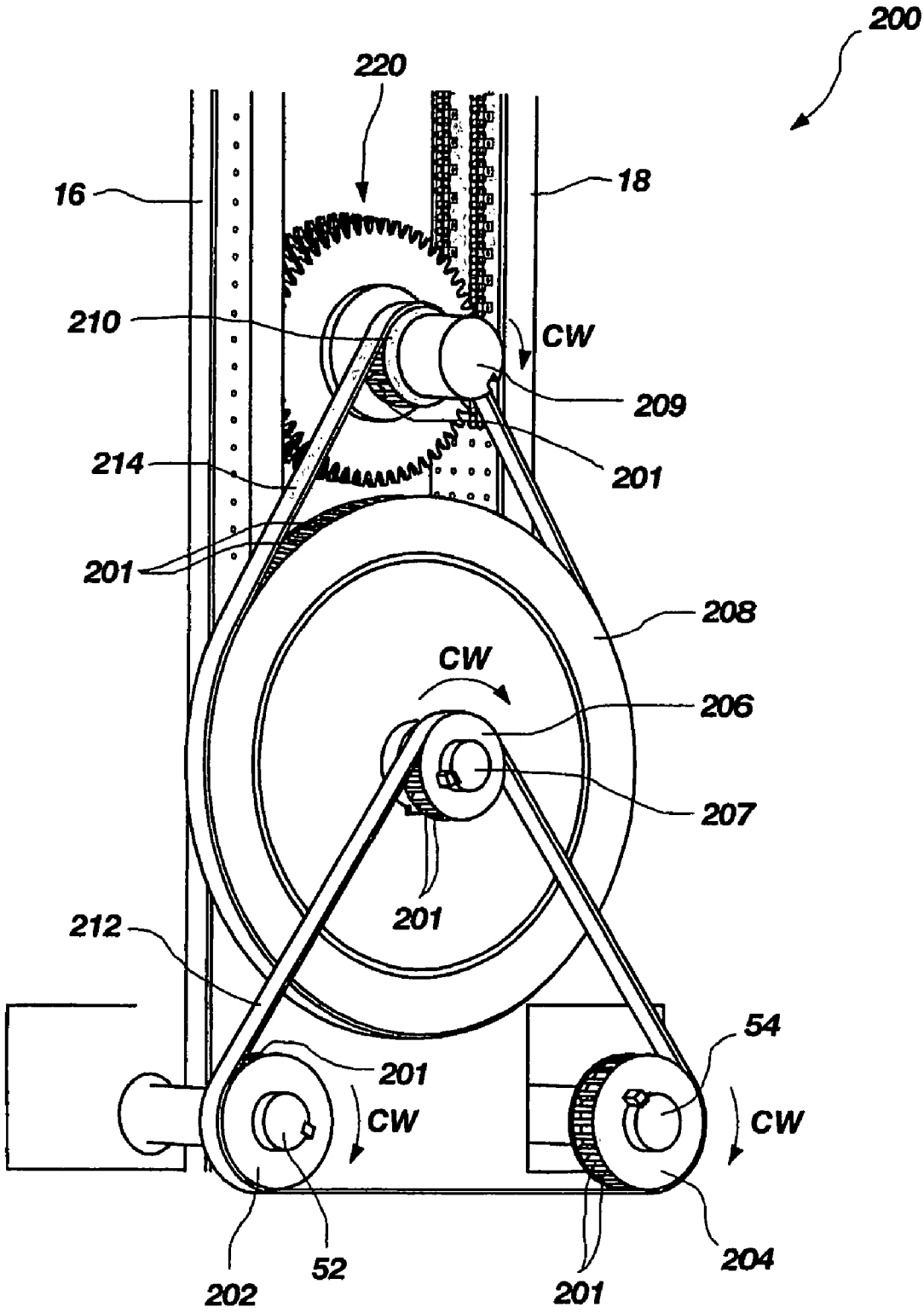
FIG. 6 shows a partial, perspective view of one embodiment of the transmission, shown in FIGS. 4 and 5.
Figure 7:
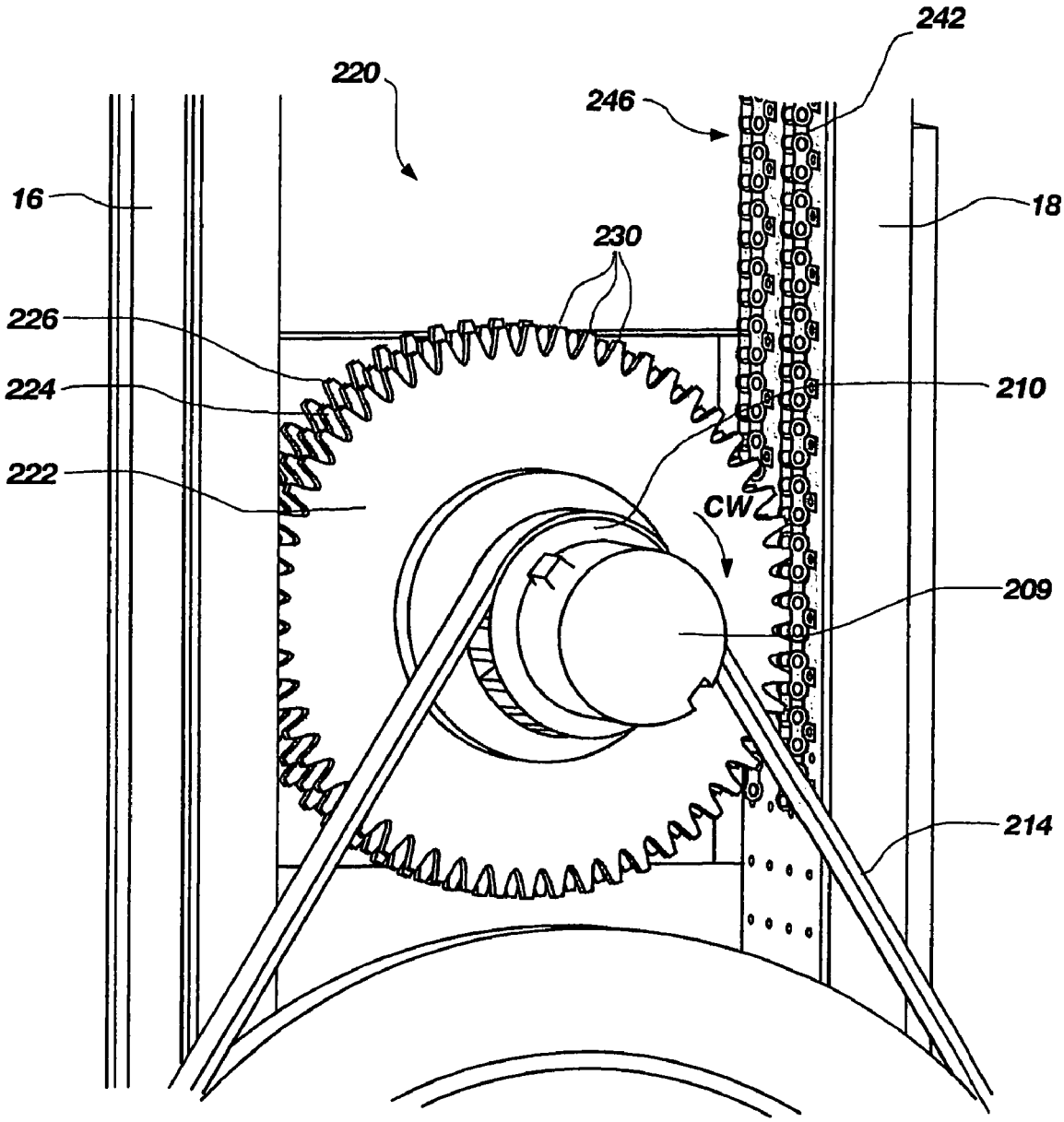
FIG. 7 shows a partial, enlarged, perspective view of the transmission shown in FIG. 6.
Figure 8:
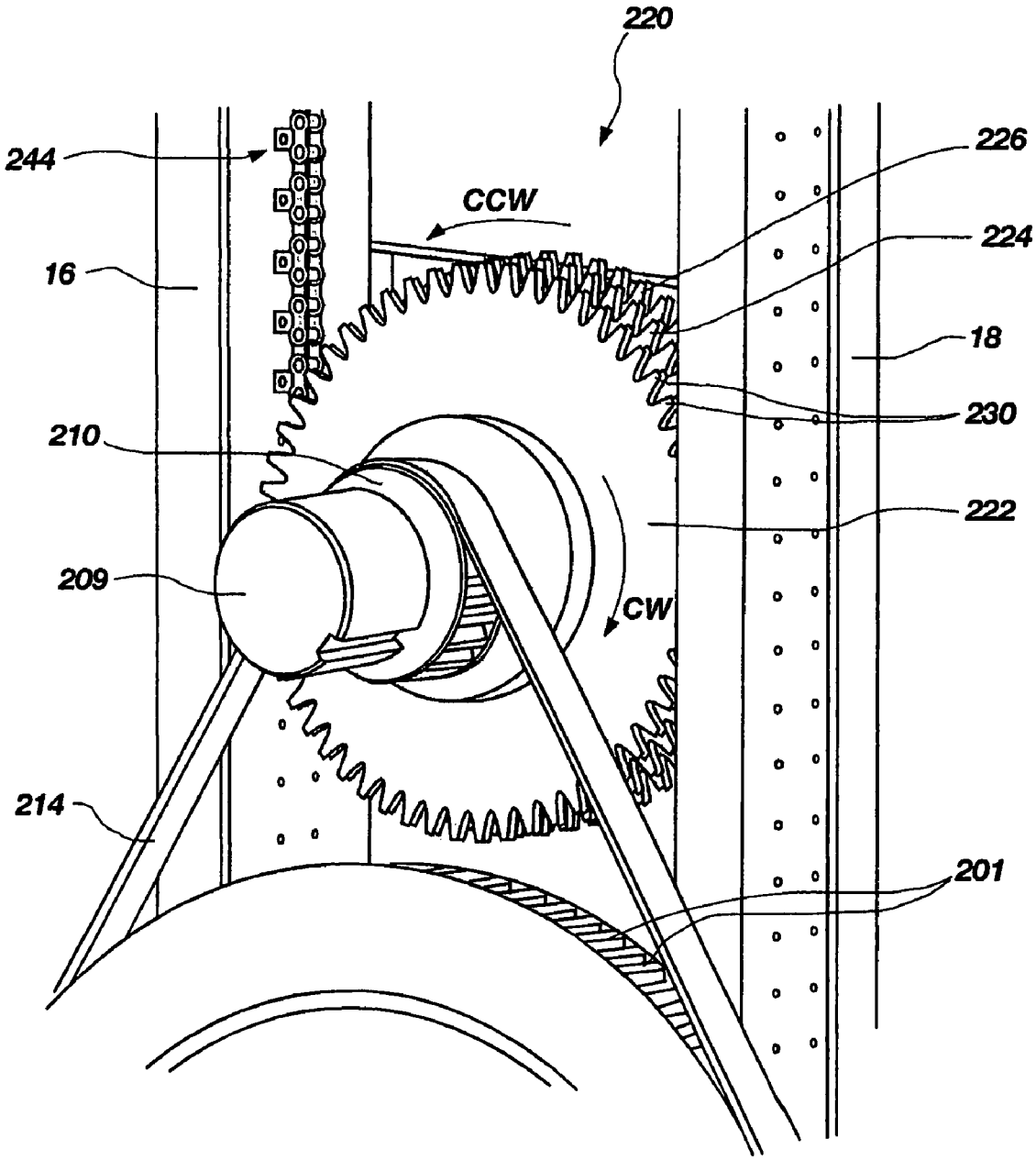
FIG. 8 shows another partial, enlarged, perspective view of the transmission shown in FIG. 6.

In further detail, FIG. 6 shows a perspective view of one embodiment of transmission 200. Platform axle 52 may include drive pulley 202, which is positioned generally at a respective end of platform axle 52. Similarly, platform axle 54 may include drive pulley 204, which is positioned generally at a respective end of drive axle 54. Further, transmission 200 includes a lower drive belt 212, a first intermediate pulley 206, a second intermediate pulley 208, an upper drive belt 214, a sprocket pulley 210, a sprocket assembly 220, an outer chain 242 (FIG. 7), an inner chain 246 (FIG. 7), and an idler chain 244 (FIG. 8). Pulleys 202, 204, 206, 208 may be coupled to a respective axle of axles 52, 54, 207, 209 by a keyway and key type coupling, welding, fastening elements (e.g., pins, threaded bolts or screws, etc.), or as otherwise known in the art. As shown in FIG. 6, drive pulley 202, drive pulley 204, first intermediate pulley 206, second intermediate pulley 208, and sprocket pulley 210 may each comprise a so-called "pinion pulley." Thus, as shown in FIG. 6, each of these pulleys include teeth 201 arranged generally about the circumference of each pulley, respectively. In addition, lower drive belt 212 and upper drive belt 214 may each be configured as a so-called "timing belt" that includes a series of teeth and grooves that are spaced to mesh with drive pulley 202, drive pulley 204, first intermediate pulley 206, second intermediate pulley 208, and sprocket pulley 210, respectively. Accordingly, as shown in FIG. 6, rotation of drive pulley 202 and drive pulley 204 in a direction labeled CW results in first intermediate pulley 206, second intermediate pulley 208, and sprocket pulley 210 rotating in a direction labeled CW. Of course, any pulley, gear, or sprocket in combination with elongated transmissive elements, such as, for instance, belts, ropes, or chains may be included by a transmission, without limitation.

Figure 8A:
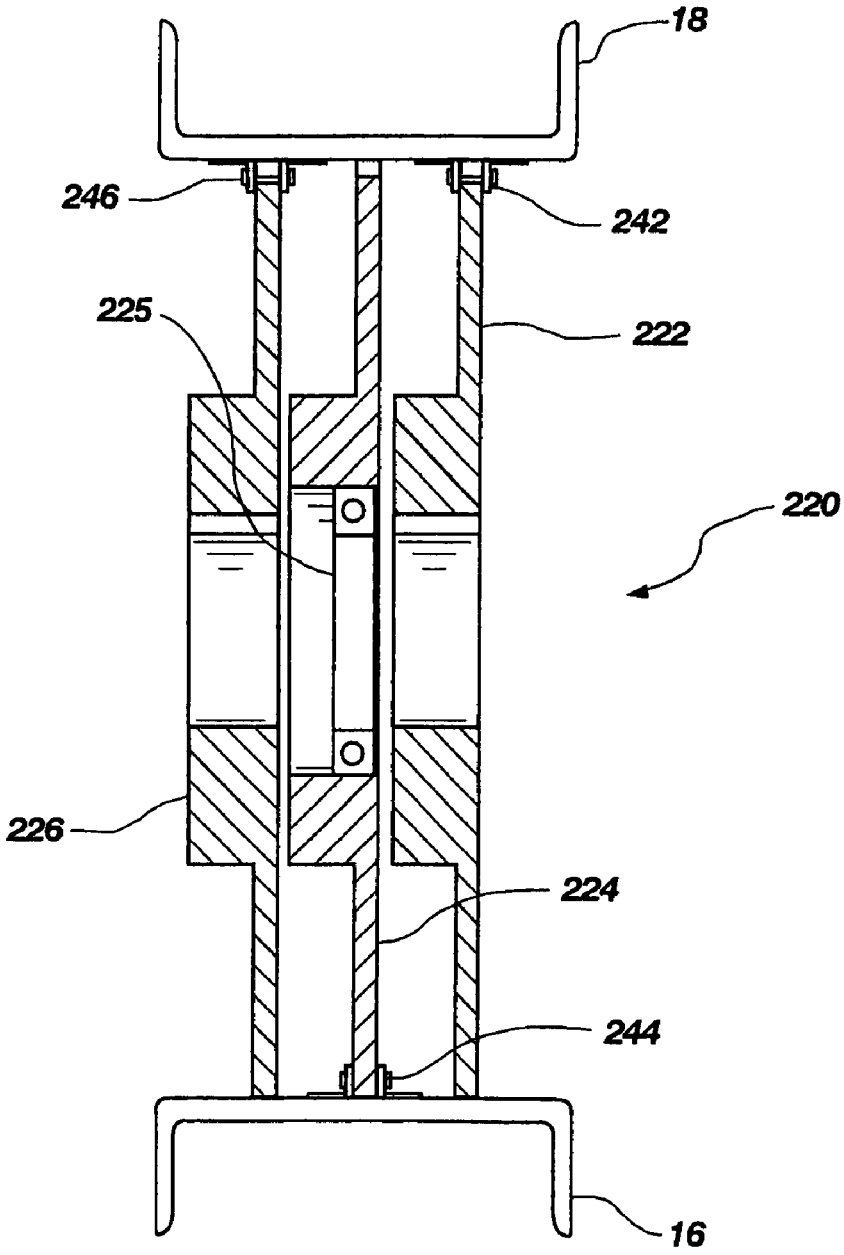
FIG. 8A shows a top view of the sprocket assembly and chains.

In further detail, sprocket assembly 220 may include an outer drive sprocket 222, an idler sprocket 224, and an inner drive sprocket 226. Further, each of outer drive sprocket 222 and inner drive sprocket 226 may be coupled to sprocket axle 209 so that rotation of sprocket axle 209 causes rotation of both outer drive sprocket 222 and inner drive sprocket 226. For example, in one embodiment a keyway and key type coupling may couple sprocket axle 209 to each of inner drive sprocket 226 and outer drive sprocket 222. Optionally, each of outer drive sprocket 222 and inner drive sprocket 226 may be coupled to sprocket axle 209 by welding, fastening elements (e.g., pins, threaded bolts or screws, etc.), or as otherwise known in the art. Idler sprocket 224 may be configured to rotate freely with respect to sprocket axle 209. For example, as discussed below, a roller bearing may suitably couple sprocket axle 209 and idler sprocket 224. Of course, other mechanisms (e.g., bushings or other bearings) may be employed for allowing rotation of sprocket axle 209 and idler sprocket 224 relative to one another. Thus, as may be appreciated with reference to FIG. 6, rotation of sprocket axle 209 may cause outer drive sprocket 222 and inner drive sprocket 226 to rotate in the same direction. Thus, sprocket teeth 230 of outer drive sprocket 222 and inner drive sprocket 226 may be caused to mesh or otherwise couple or engage to outer chain 242 and inner chain 246, respectively. Explaining further, FIGS. 7 and 8 show perspective views of sprocket assembly 220 and idler chain 244. FIG. 8A shows a top view of the sprocket assembly 220 and chains 242, 244, 246. Upon rotation of sprocket axle 209 in a direction CW, idler sprocket 224 may rotate in a direction CCW (i.e., an opposite direction of rotation of sprocket axle 209) via roller bearing 225 (FIG. 8A) and may mesh with or otherwise couple or engage to idler chain 244, as shown in FIGS. 7, 8, and 8A. Thus, at least one roller may be used to cause the sprocket assembly 220 and moveable platform to move relative to support frame 10. Such a sprocket assembly 220 may provide a relatively robust and stable mechanism for transforming a torque applied to at least one roller into a lifting force for lifting the moveable platform 50, a wheelchair positioned upon the moveable platform 50, and an occupant of the wheelchair. In one embodiment, the above-described transmission 200 may generate at least about 600 pounds of force for moving the platform assembly substantially vertically in response to application of about 12 pounds of force applied tangentially to rollers 56 and 57. Of course, each transmission 200 may generate such a mechanical advantage; therefore, a force of about 12 pounds applied tangentially to rollers 56, 57, 58, 59 may produce a total vertical force of at least about 1,200 pounds. By way of example, a conventional wheelchair may require approximately 12 pounds of force applied tangentially to its wheels in order to traverse a substantially horizontal surface. In this manner, the operator of the wheelchair can raise the lift using the same force normally exerted to traverse horizontal surfaces.

As discussed above, lift apparatus 100 may be operated so that moveable platform 50 is selectively positioned relative to support frame 10. More particularly, at least one wheel of a wheelchair may interact with at least one roller of the moveable platform 50 and may drive transmissions 200 that couple support frame 10 and moveable platform 50. Of course, rotation of at least one wheelchair wheel may be caused by a user of the wheelchair, by an electric motor (e.g., in the case of an electric wheelchair), or as otherwise known in the art. It should also be appreciated that a lift apparatus may be utilized and operated by various wheeled objects (e.g., carts, or other wheeled devices for enhancing mobility of a person).

Figure 9:
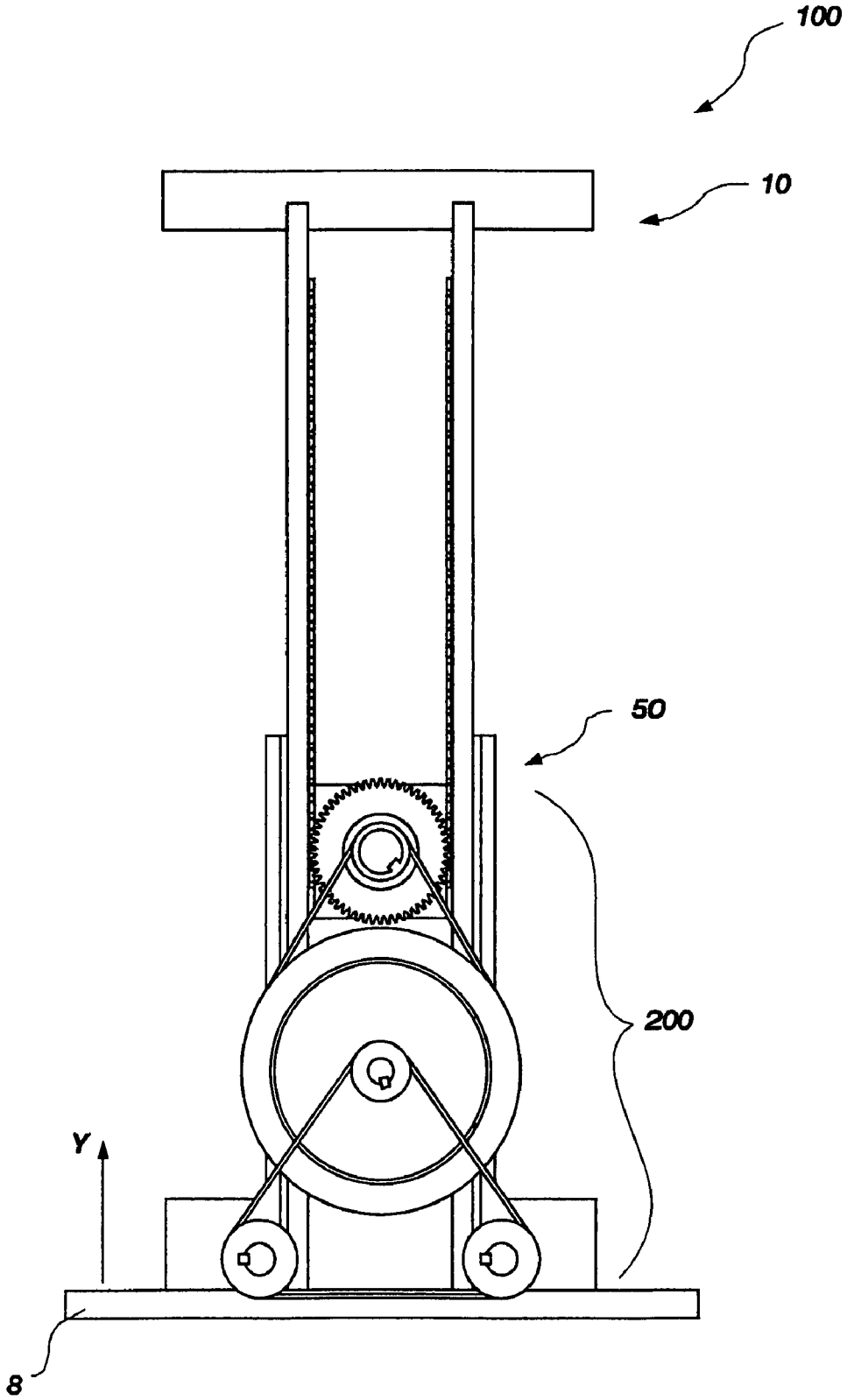
FIG. 9 shows a side view of the embodiment of the lift apparatus shown in FIG. 4, wherein the moveable platform is positioned adjacent to the frame base of the support frame.
Figure 10:
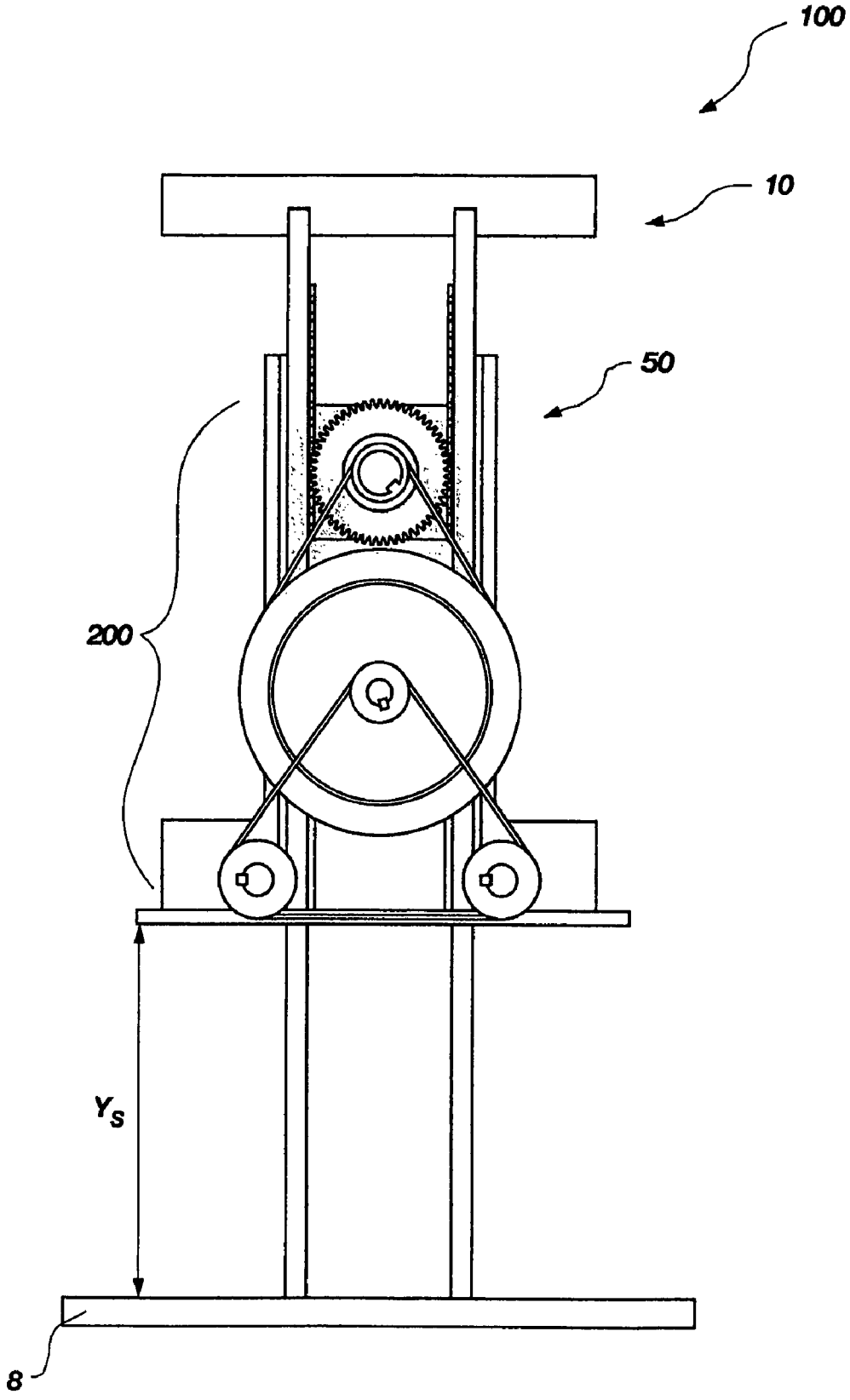
FIG. 10 shows a side view of the embodiment of the lift apparatus shown in FIG. 4, wherein the moveable platform is positioned at a selected distance relative to the frame base of the support frame.

FIG. 9 shows a side view of lift apparatus 100, where moveable platform 50 may be moved generally in direction Y with respect to frame base 8 to a selected position. For example, as shown in FIG. 10, moveable platform 50 may be positioned at a selected position $Y_s$ with respect to frame base 8. Accordingly, it may be appreciated that lift apparatus 100 may be advantageous for moving (e.g., changing an elevation of) a wheelchair and a person positioned in the wheelchair. For example, the present invention contemplates that lift apparatus 100 may be operated to move a person in a wheelchair between two different elevations. In addition, optionally, the present invention contemplates that a lift apparatus 100 may be operably coupled to a ramp system, as discussed in greater detail below.

Figure 11:
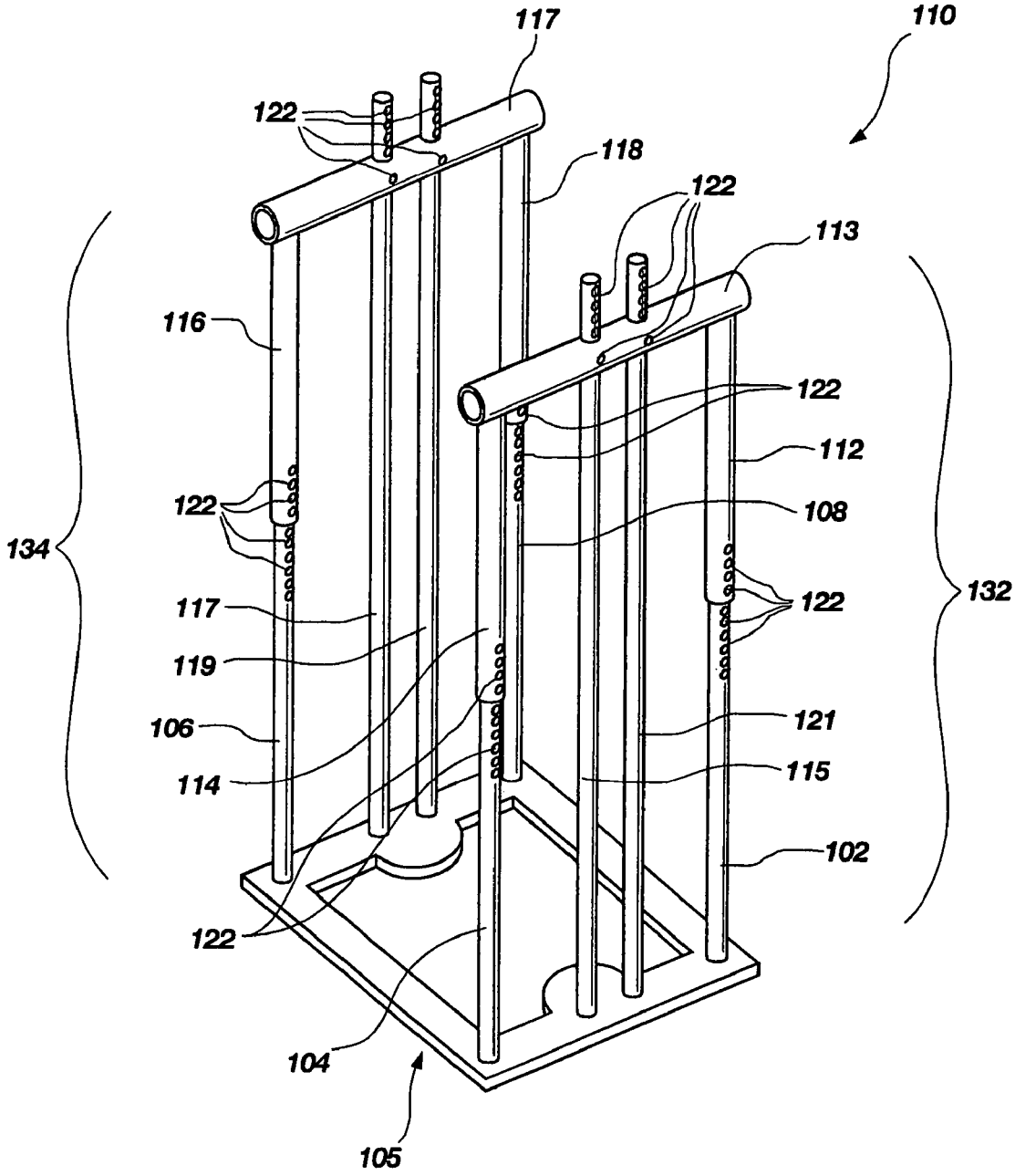
FIG. 11 shows a perspective view of another embodiment of a support frame.

Of course, the present invention contemplates many various embodiments relative to a support frame, a moveable platform, and a transmission coupling the moveable platform to the support frame. For example, FIG. 11 shows a perspective view of a support frame 110 including a frame base 105 and a plurality of columns extending from the frame base 105. Explaining further, a first plurality of columns may extend from frame base 105 to form a first columnar assembly 134 and a second plurality of columns may extend from frame base 105 to form a second columnar assembly 132. As shown in FIG. 11, columnar assembly 134 assembly may include columns 116 and 118, which are both affixed to cross brace 117 and wherein at least a portion of each of columns 116, 118 may be positioned over or otherwise overlap with at least a portion of each of columns 106, 108, respectively. Similarly, a second columnar assembly 134 of support frame 110 may include columns 112, 114 affixed to cross brace 113 wherein columns 112, 114 may be positioned over or may otherwise at least partially overlap with columns 121, 115, respectively. As shown in FIG. 11, columns 116, 118 and columns 112, 114 may be selectively positionable with respect to columns 106, 108 and columns 102, 104, respectively. More specifically, in one embodiment, a plurality of holes 122 may be formed in each of columns 116, 118, 106, 108, 102, 104, 112, 114 and a fastening element (e.g., a pin, a bolt, a screw, etc.) may be positioned within selected, aligned holes 122 so that columns 116, 118 may be positioned with respect to columns 106, 108 and columns 114, 112 may be positioned with respect to columns 102, 104. Such a configuration may allow for adjustability relative to a range of elevations at which a moveable platform coupled to the support frame 110 may be positioned.

Figure 12:
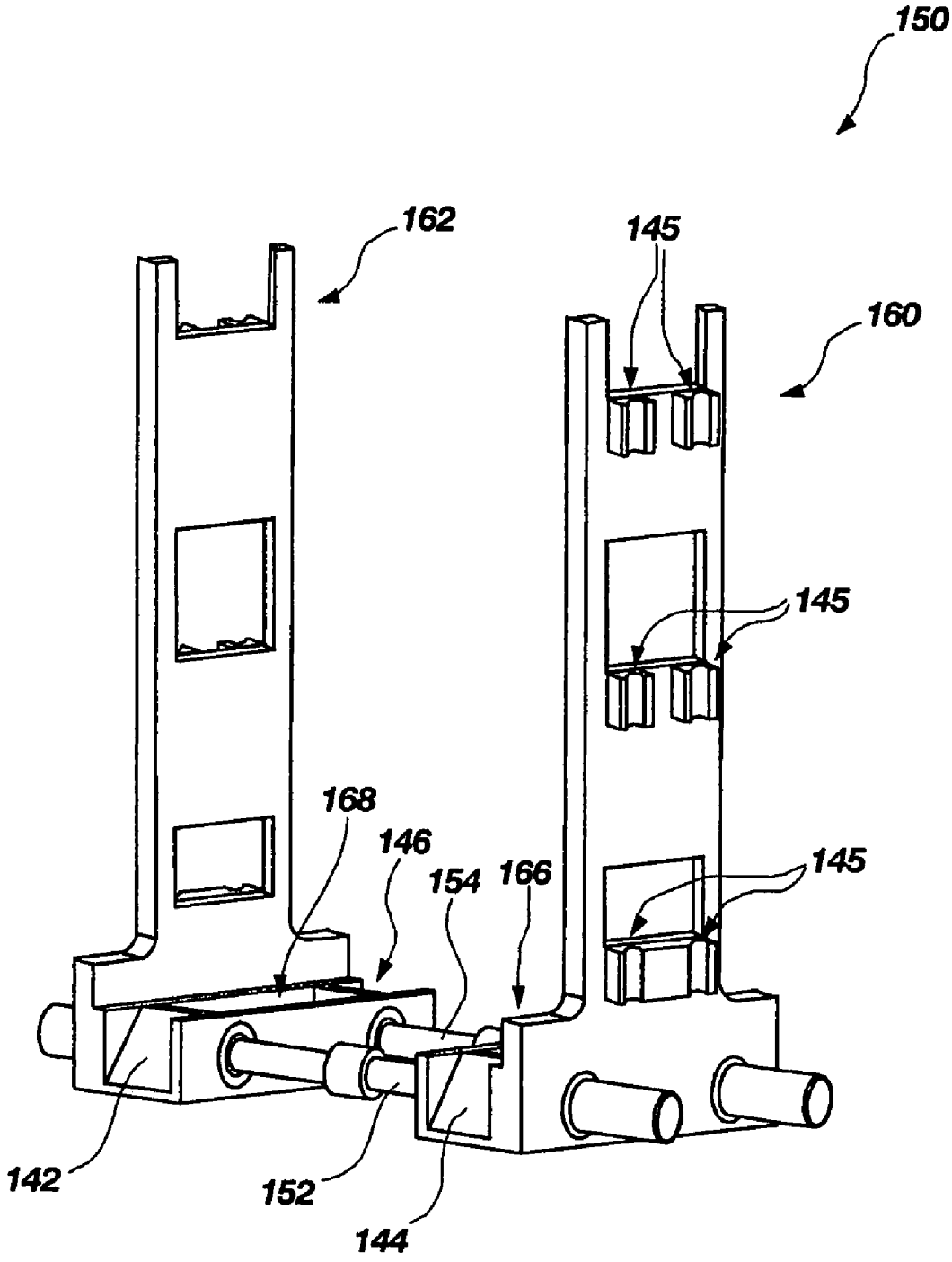
FIG. 12 shows a perspective view of another embodiment of a moveable platform including a first platform leg, a second platform leg, and two drive axles, wherein each of the drive axles extends through both of the platform legs.

There are many moveable platform embodiments contemplated by the present invention which may be coupled to a support frame 10 as shown in FIG. 1. For example, FIG. 12 shows a perspective view of one embodiment of a moveable platform 150 including platform legs 160, 162 and a plurality of arcuate recesses 145 that are formed in a side region of each of platform legs 160, 162. Such arcuate recesses 145 may be configured for alignment with columns 115, 121 and columns 117, 119 of support frame 110, respectively. Of course, optionally, linear bearings, bushings, sacrificial wear coatings or elements (e.g., TEFLON®, nylon, bronze, etc.) or other structures as known in the art for facilitating relative motion between two surfaces (i.e., arcuate recesses 145 and columns 115, 121, 117, 119, respectively) may be positioned between arcuate recesses 145 and columns 115, 121, 117, 119.

Figure 13:
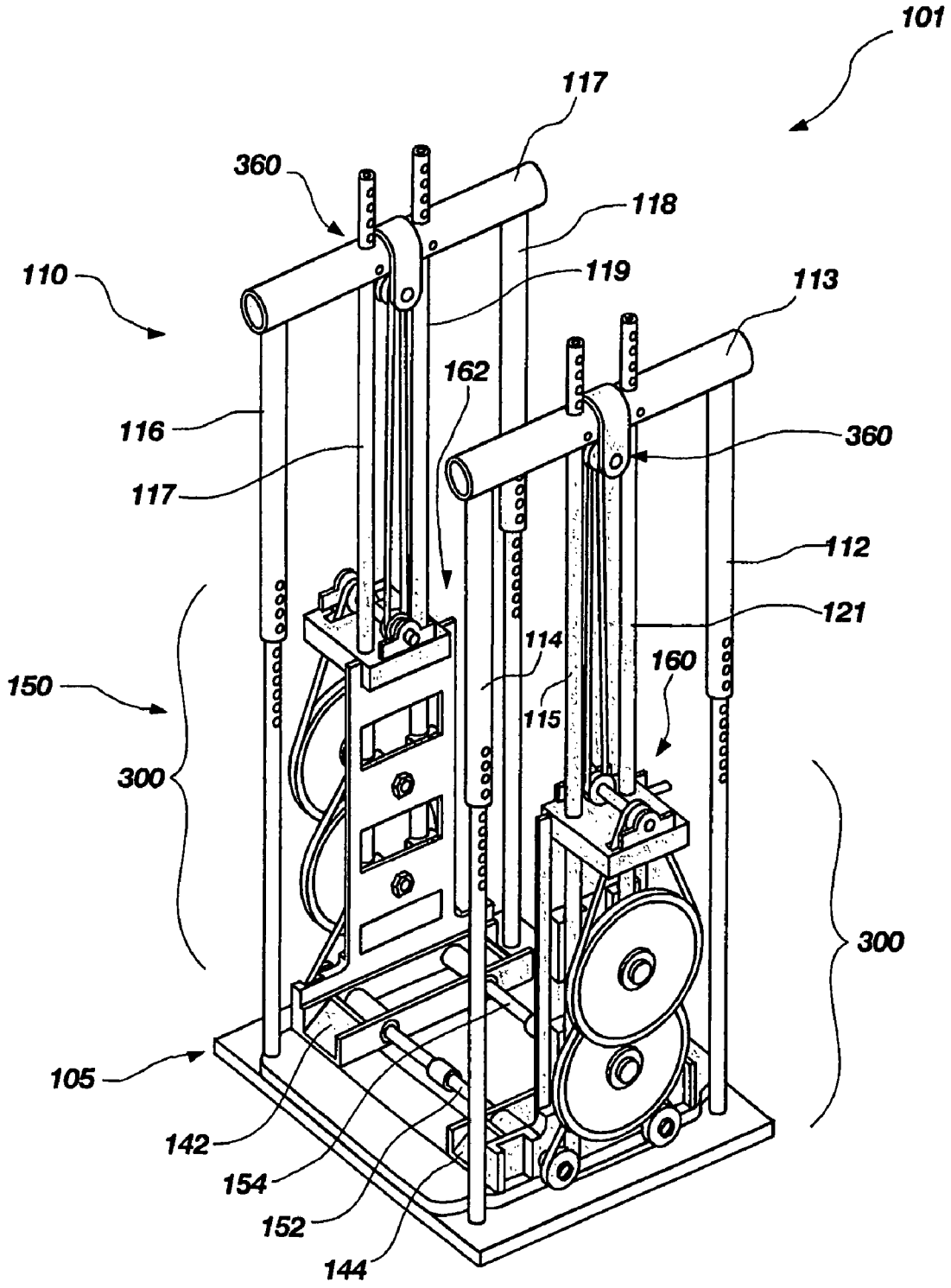
FIG. 13 shows a perspective view of one embodiment of a lift apparatus including the support frame shown in FIG. 11 and the moveable platform shown in FIG. 12.

The present invention further contemplates that moveable platform 150 may be operably coupled to support frame 110 via a transmission configured for moving the moveable platform 150 with respect support frame 110. For example, FIG. 13 shows a perspective view of one embodiment of a lift apparatus 101 including a moveable platform 150 coupled to a support frame 110 via a transmission. In addition, generally, moveable platform 150 may include at least one roller operably coupled to the transmission. Similar to lift apparatus 100, as described above, in one embodiment, a transmission may comprise two sub-assemblies, wherein the two sub-assemblies (e.g., separate transmissions 300, respectively) are coupled to columnar assemblies 132, 134 of the support frame 110. More particularly, each of support legs 160, 162 may include substantially identical transmissions 300. Further, as shown in FIG. 13, moveable platform 150 may include rollers 156, 157, 158, 159. Such rollers 156, 157, 158, 159 may be positioned generally within wheel recesses 166, 168 and may be structured for supporting a wide variety wheelchair wheel shapes and sizes. Thus, a wheelchair may be moved over frame base 105 and along ramp regions 142, 144 until a portion of at least one wheel of the wheelchair contacts or otherwise interacts with at least one roller positioned generally within at least one of wheel recesses 166, 168. For example, rotation of at least one wheel of the wheelchair contacting the at least one roller may cause transmission 300 to move the moveable platform 150 relative to support frame 110.

Figure 14:
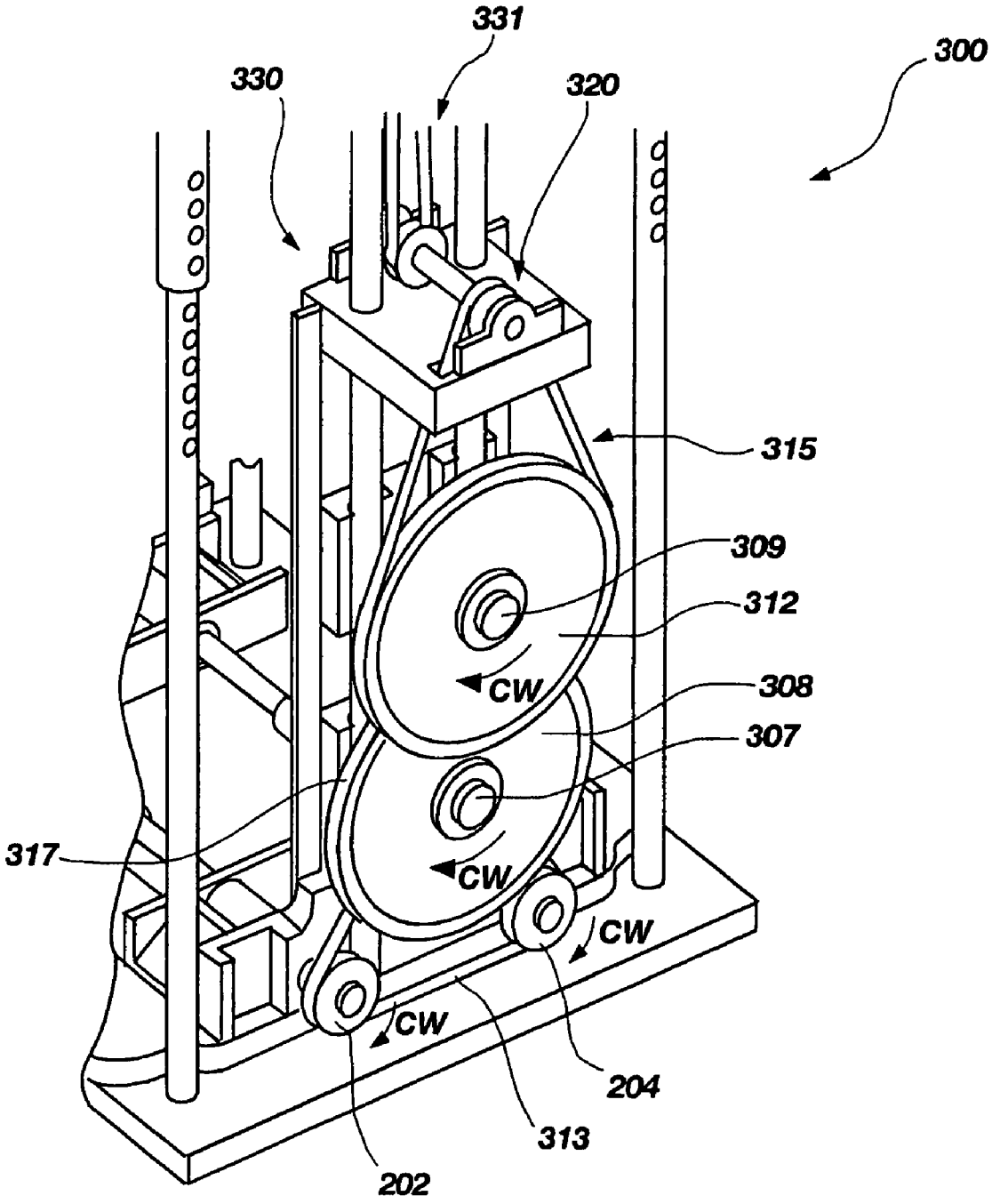
FIG. 14 shows a partial, perspective view of a transmission as shown in FIG. 13.
Figure 15:
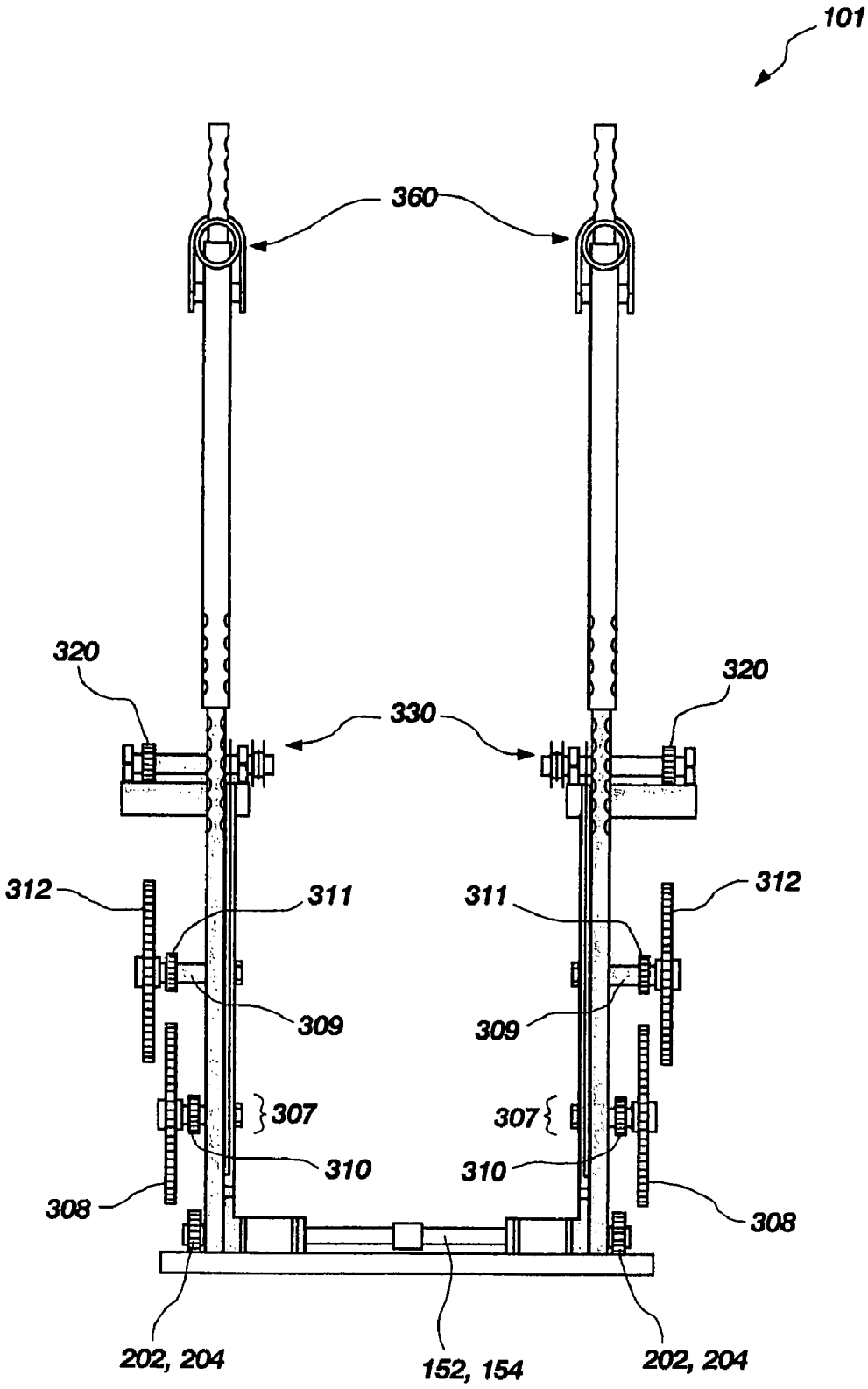
FIG. 15 shows an end view of the lift apparatus shown in FIG. 13.

In further detail, FIGS. 14 and 15 show a partial perspective view of transmission 300 and an end view of lift apparatus 101 depicting various components of transmission 300, respectively. As shown in FIG. 14, transmission 300 may generally include drive pulleys 202, 204, a lower drive belt 313, a first intermediate pulley 310 and a second intermediate pulley 308 coupled to a first intermediate axle 307, a third intermediate pulley 311 and a fourth intermediate pulley 312 coupled to a second intermediate axle 309, an intermediate drive belt 317, a cable pulley assembly 330, and an upper drive belt 315. In addition, a cable 331 may extend between cable pulley assembly 330 and an upper lift pulley 360. Thus, as drive pulleys 202, 204 rotate, first intermediate pulley 310, second intermediate pulley 308 coupled to a first intermediate axle 307, third intermediate pulley 311, fourth intermediate pulley 312, and cable drive pulley 320 may rotate to cause shortening or lengthening of cable 331 extending between cable pulley assembly 330 and upper lift pulley 360. Accordingly, moveable platform 150 may move relative to support frame 110.

It may further be appreciated that the present invention contemplates that, optionally, a portion of the support frame may be adjustable or moveable. For example, the present invention contemplates that it may be advantageous to rotate the support frame. Such a configuration may allow for positioning the moveable platform at a plurality of different exit or entrance regions, if desired. Further, the present invention contemplates that at least a portion of a support frame (e.g., at least one column or columnar assembly) may be configured to tilt, or otherwise distort or rotate to provide access to a plurality of different exit or entrance regions, if desired, without limitation.

Figure 16:
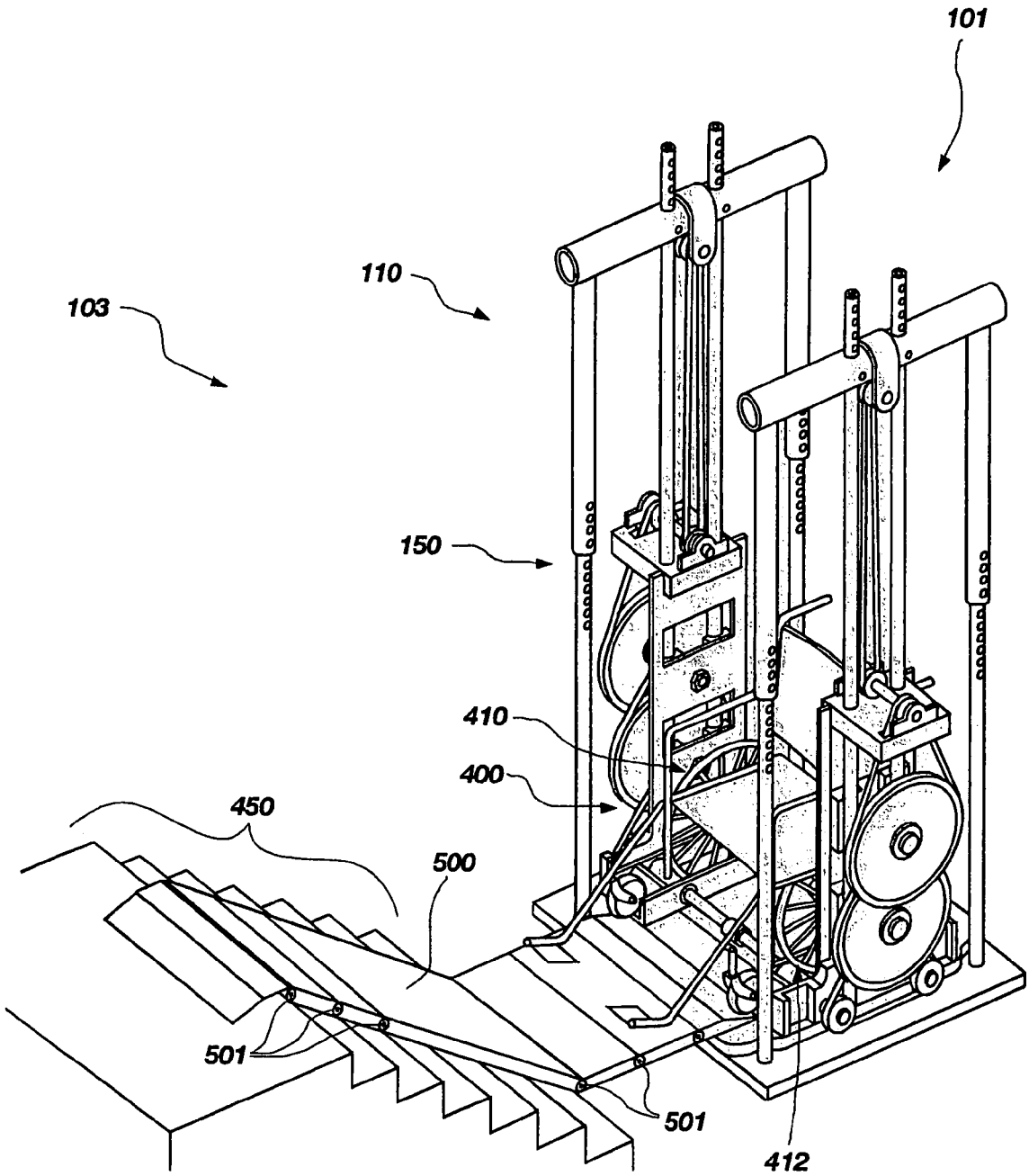
FIG. 16 shows a perspective view of a lift system including the lift apparatus shown in FIG. 13 and a ramp system.
Figure 17:
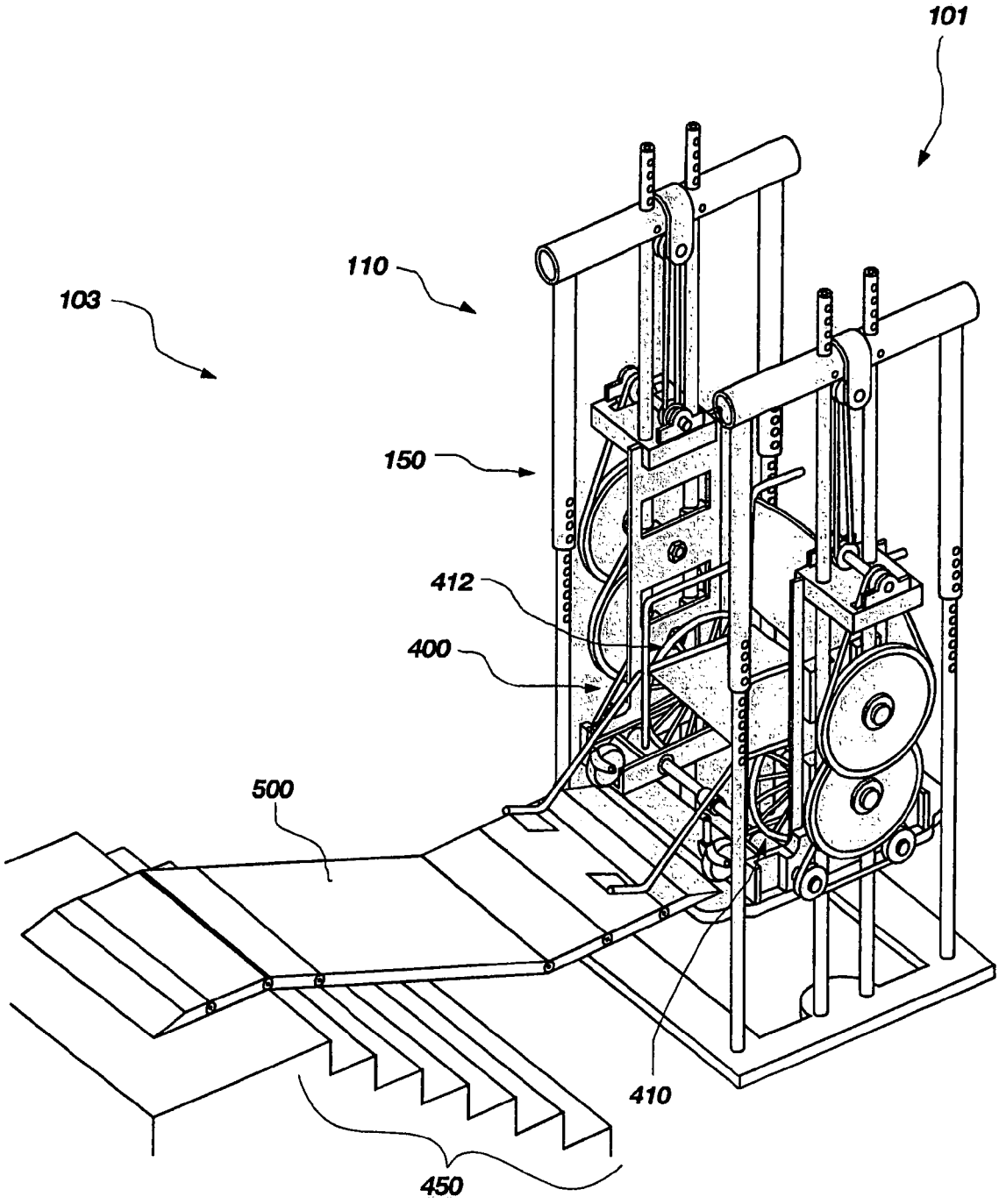
FIG. 17 shows a perspective view of the lift system shown in FIG. 17, wherein the moveable platform is positioned at a selected position.
Figure 18:
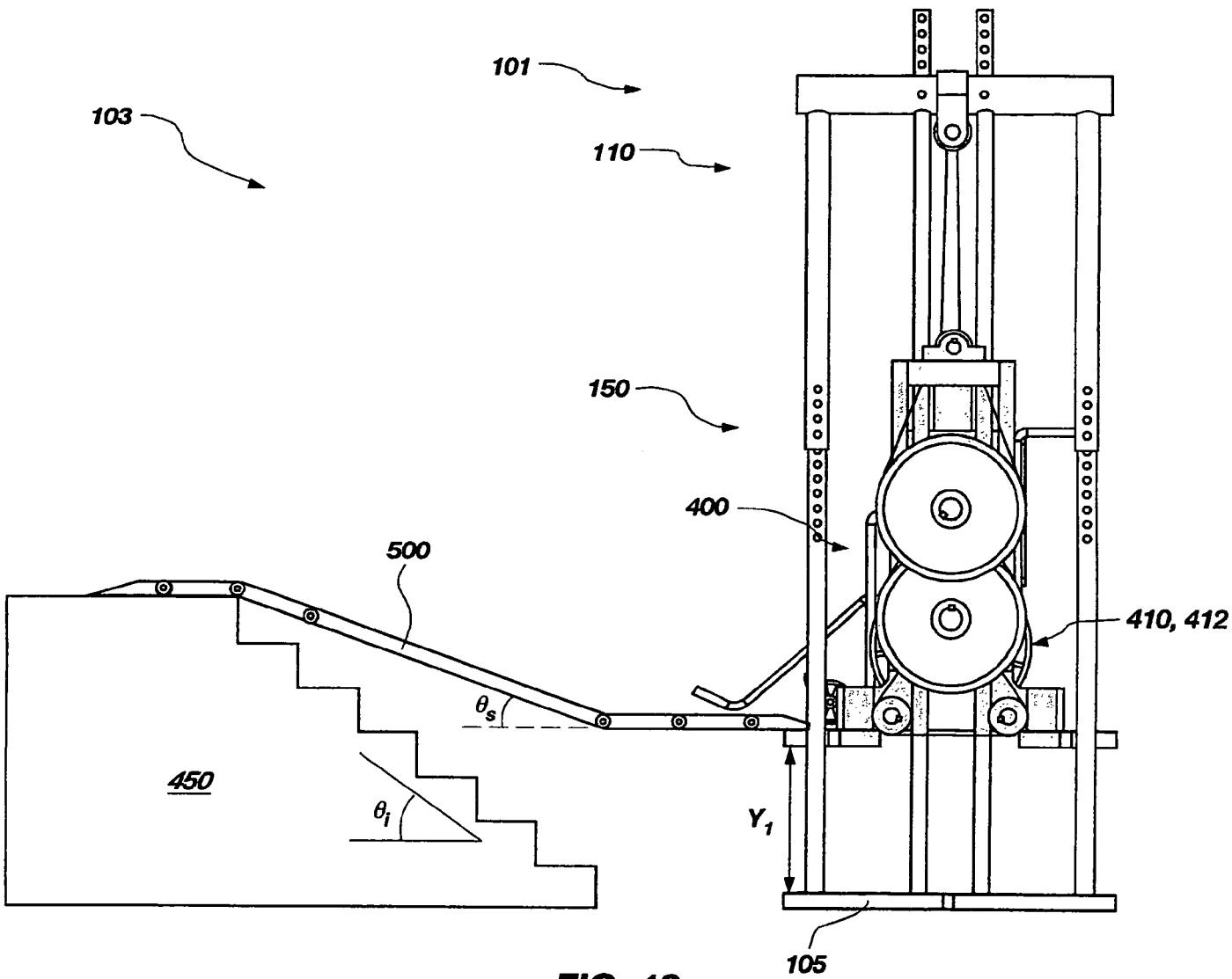
FIG. 18 shows a side view of the lift system shown in FIG. 17.
Figure 19:
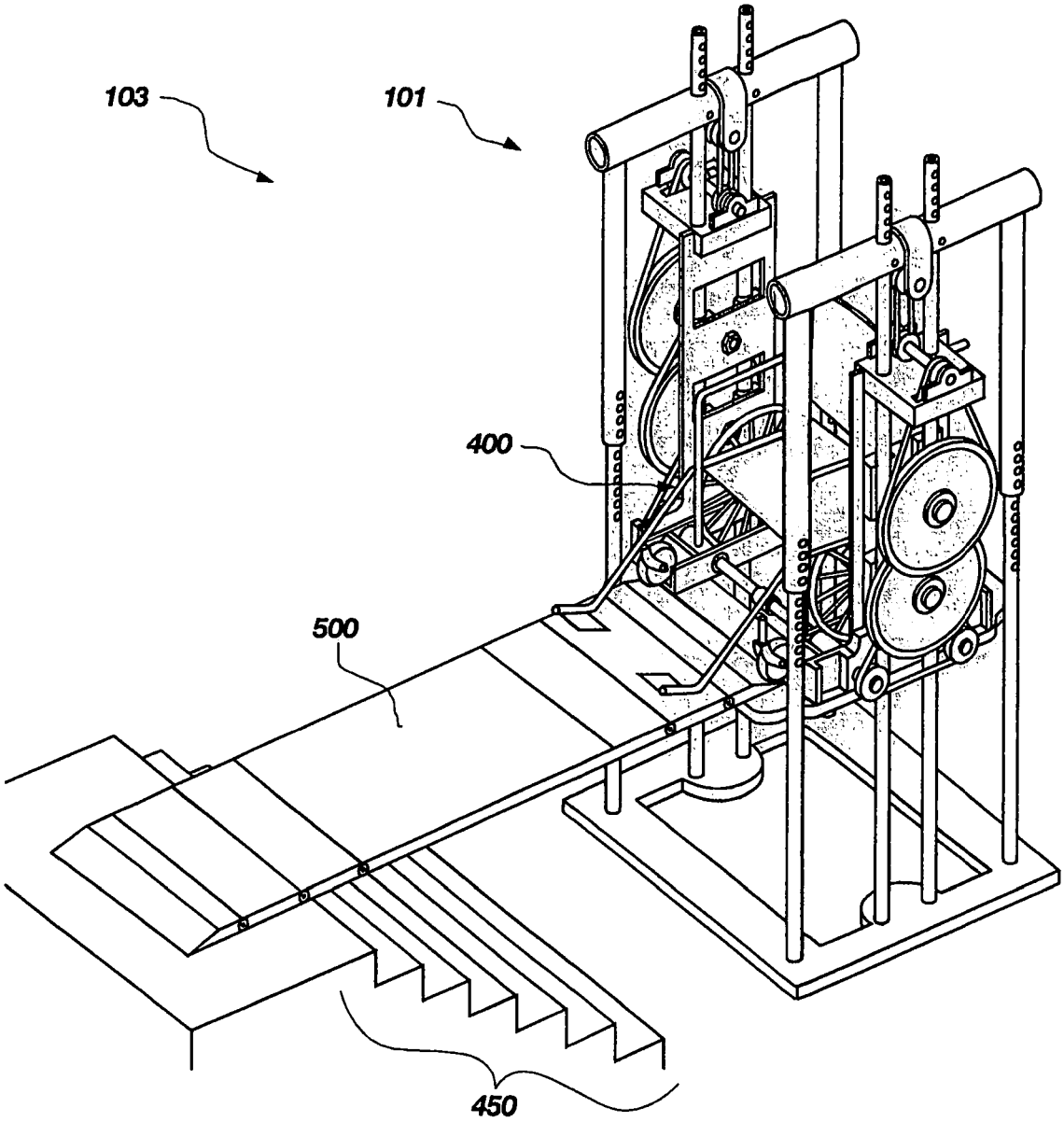
FIG. 19 shows a perspective of the lift system shown in FIG. 16, wherein the moveable platform is positioned so that the ramp is substantially horizontal.
Figure 20:
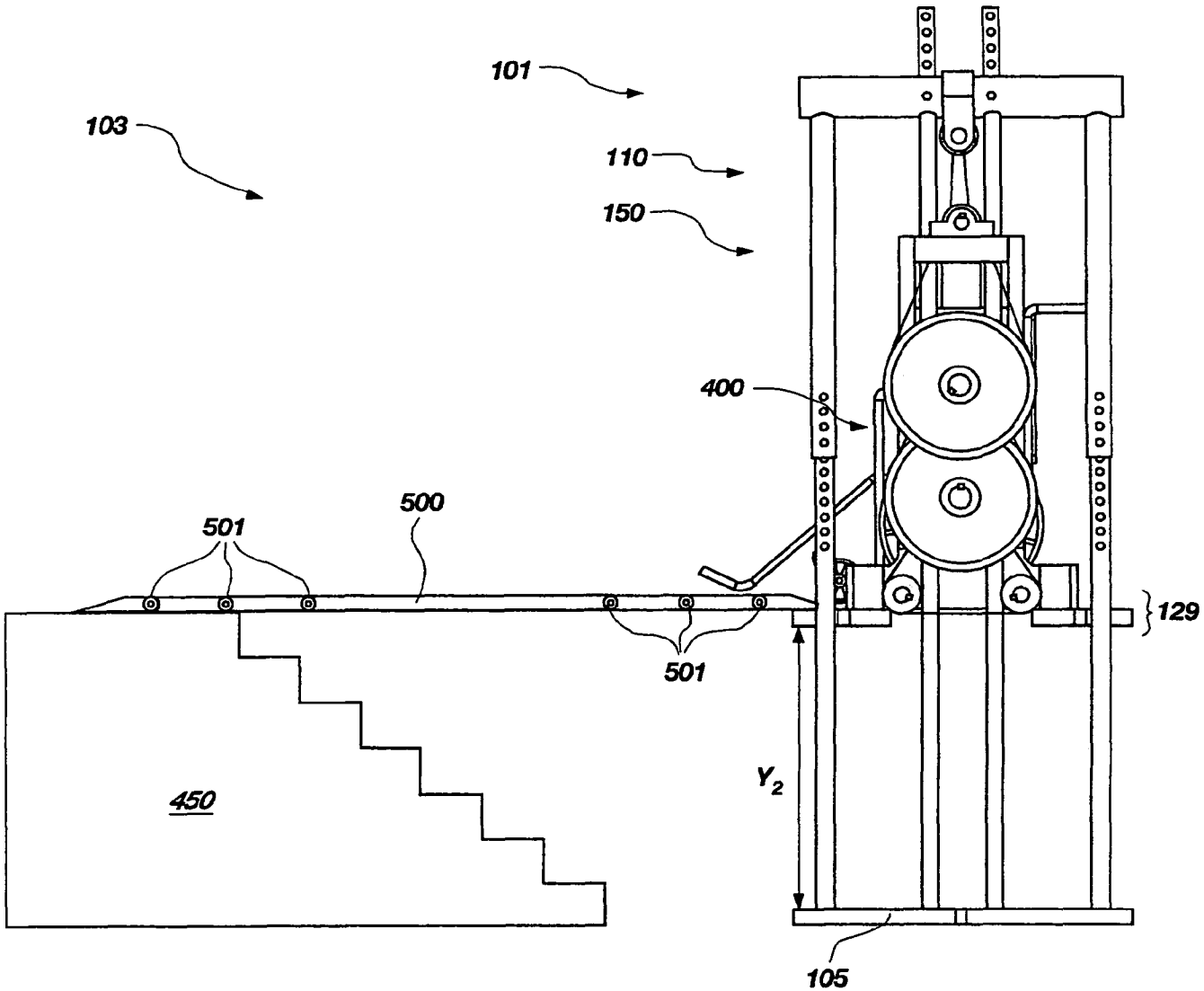
FIG. 20 shows a side view of the lift system shown in FIG. 19.

In a further aspect of the present invention, as mentioned above, a lift system may include a lift apparatus and a ramp system. Such a lift system may be advantageous for allowing a wheelchair to traverse a region exhibiting varying elevation (e.g., an incline or decline). For example, FIG. 16 shows a perspective view of a lift system 103 including a lift apparatus 101 and a ramp system 500. As shown in FIG. 16, a wheelchair 400 may be positioned generally within lift apparatus 101 and may be supported by moveable platform 150. As described above, at least one of wheels 410, 412 of wheelchair 400 may contact at least one roller of moveable platform 150. In addition, as shown in FIG. 16, ramp system 500 may include one or more hinges 501, wherein hinges 501 are structured and positioned so that ramp system 500 may at least partially conform to or follow inclined region 450, when moveable platform 150 is positioned proximate to frame base 105. As discussed above, at least one of wheelchair wheels 410, 412 may be rotated to cause moveable platform 150 to move relative to support frame 110. More particularly, as shown in FIGS. 17 and 18, moveable platform 150 may be positioned at a selected position $Y_1$ with respect to frame base 105 of support frame 110. Such a selected position $Y_1$ may position at least a portion of ramp system 500 at a selected angle $Ø_s$, which is able to be traversed by a person operating wheelchair 400. Put another way, a person operating a wheelchair may selectively position moveable platform 150 so that ramp system 500 is traversable by the wheelchair. Of course, as shown in FIG. 18, moveable platform 150 may be positioned so that a magnitude of $Ø_s$ is less than a magnitude of $Ø_i$ to allow wheelchair 400 to traverse ramp system 500 and move over inclined region 450. If desired, lift apparatus 101 may be positioned so that ramp system 500 is substantially horizontal, as shown in FIGS. 19 and 20 in a perspective view and schematic side view, respectively. Thus, it may appreciated that hinges 501 may be configured for allowing relative rotation of adjacent sections of ramp system 500 within selected limits and, optionally, in selected directions. Accordingly, as shown on FIG. 20, when moveable platform 150 is positioned at position $Y_2$ relative to frame base 105 of support frame 110, ramp system 500 may provide a robust, stable, relatively unyielding bridge for allowing wheelchair 400 to traverse inclined region 450. The present invention further contemplates that lift system 103 may include another ramp system (e.g., a second ramp system 500) operably coupled to moveable platform 150 proximate to side region 129 of moveable platform 150. Such a configuration may facilitate movement of a wheelchair generally away from inclined region 450 toward lift apparatus 101.

Thus, generally, in one embodiment, a ramp may be connected to at least one side of a lift apparatus. In one embodiment, the ramp may optionally be a solid, rigid piece of material or the ramp may be a foldable or collapsible or telescoping scaffold. As explained above, one end of the ramp may be attached to a lift apparatus so that that end raises as the moveable platform assembly raises. The ramp may bridge one or more steps, so that the user may traverse the one or more steps by raising the lift to a desired height and using the ramp as a bridge to at least a portion of the raised elevation of the one or more steps. In one embodiment, the lift apparatus may be raised to a predetermined height at which the ramp is substantially horizontal.

Figure 21:
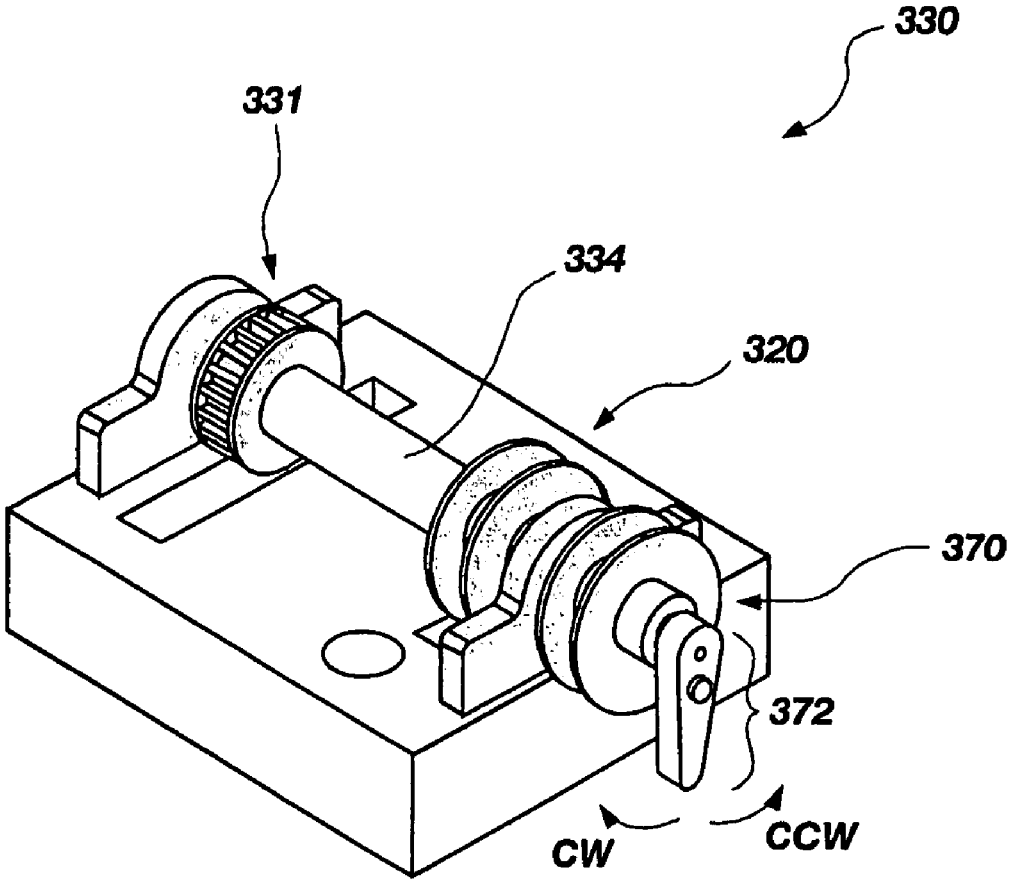
FIG. 21 shows a perspective view of a cable pulley assembly including a ratchet mechanism.

Optionally, a lift apparatus may include a limit mechanism that allows movement of the moveable platform assembly in a selected direction relative to the support frame and limits movement of the moveable platform in a direction opposite to the selected direction. Such a limit mechanism may include a locking feature that limits movement of the moveable frame in a particular direction but allows movement in another direction. Of course, such a locking feature may be selectively switched so that the moveable frame may be moved in the selected direction and limited in movement in another direction (and vice versa). For example, in one embodiment, a limit mechanism may comprise a ratchet that is operably coupled to a rotating element of a transmission coupling a moveable platform to a support frame. Particularly, FIG. 21 shows a perspective view of a cable pulley assembly 330 including a ratchet mechanism 370 operably coupled to an axle 334 of cable pulley assembly 330. Thus, ratchet mechanism 370 may be structured to allow for rotation of axle 334 and cable drive pulley 331 in a direction CW, but may limit rotation of axle 334 and cable drive pulley 331 in a direction CCW or vice versa. As shown in FIG. 21, ratchet mechanism 370 may include toggle 372, which is structured for changing the operation of the ratchet mechanism 370. More particularly, rotation of toggle 372 to a predetermined position may determine the direction of allowed rotation and the direction of limited rotation (e.g., CW allowed and CCW limited or CCW allowed and CW limited, respectively) or may disable the ratchet mechanism 370. As may be appreciated, one or more cables, one or more slender members, or any other structure suitable for operating ratchet mechanism 370 may be affixed to toggle 372 of ratchet mechanism 370 and may be accessible or otherwise operable by a wheelchair occupant positioned within a lift apparatus as discussed above.

Further, at least one ratchet mechanism 370 (or any other limit mechanism), as discussed above, may be operably coupled to any rotating element (e.g., an axle, sprocket, gear, etc.) of a transmission, without limitation. Further, such a ratchet mechanism may be coupled to at least one roller of the moveable platform, if desired. Other limit mechanisms are contemplated by the present invention. For example, a limit mechanism may comprise at least one biased pin that traverses a series of locking recesses or ledges as the moveable platform moves in a selected direction.

Figure 31:
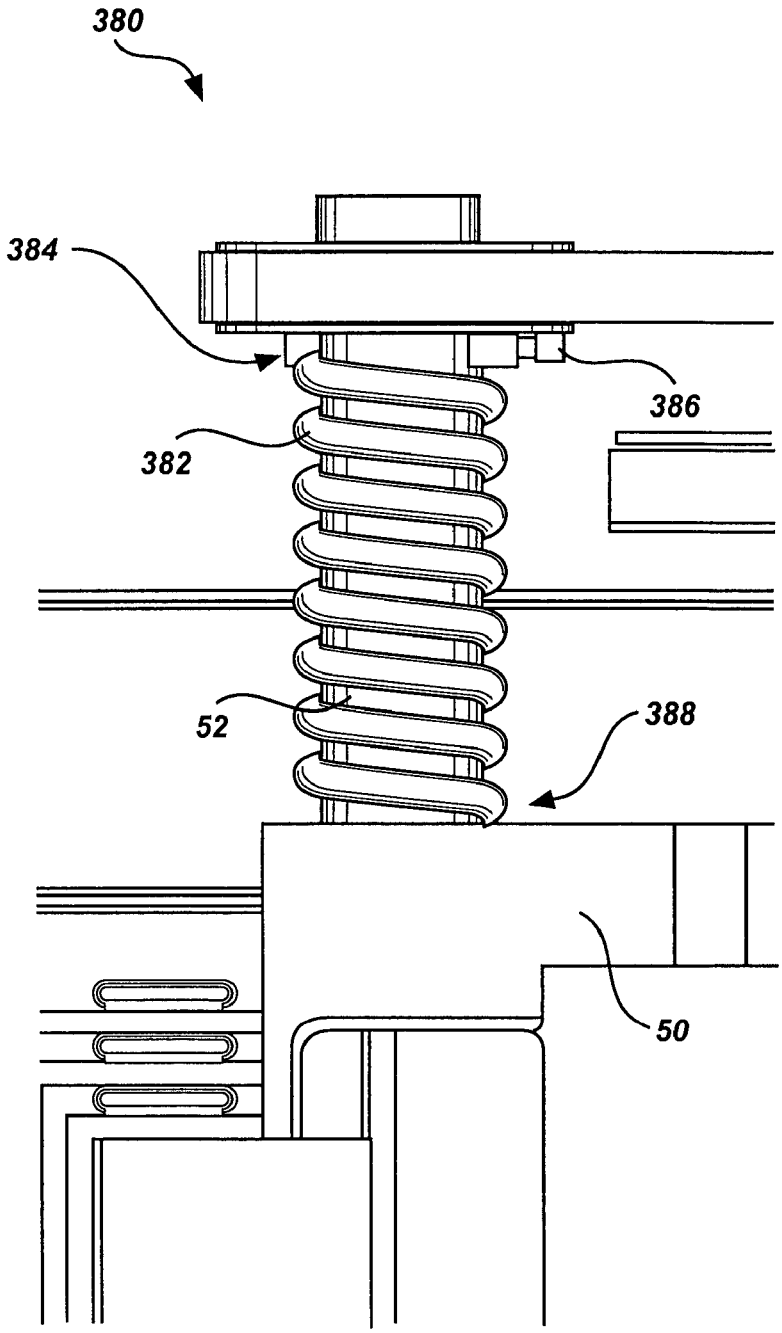
FIG. 31. shows a detailed view of one embodiment of a spring biasing system.

FIG. 31 shows a detailed view of another embodiment of a limit mechanism that may be used in connection with lift apparatus 100, 101. Spring biasing system 380 may comprise four helical springs 382, each having an outer end 384 that is attached via an adjustable connector 386, such as a screw, locking collar, or other suitable connector, to each end of axles 52, 54, 152, 154 and an inner end 388 that is welded or otherwise fixably attached to moveable platform 50, 150. Helical springs 382 may be placed such that when moveable platform 50, 150 is moved in an upward direction, helical springs 382 unwind or decompress, thereby counteracting the weight of the wheelchair and passenger and assisting with upward motion while resisting or limiting motion in the opposite, downward direction. In addition, each adjustable connector 386 may be tightened or loosened to adjust the pitch of corresponding helical spring 382 to achieve an appropriate level of spring tension.

Figure 32:
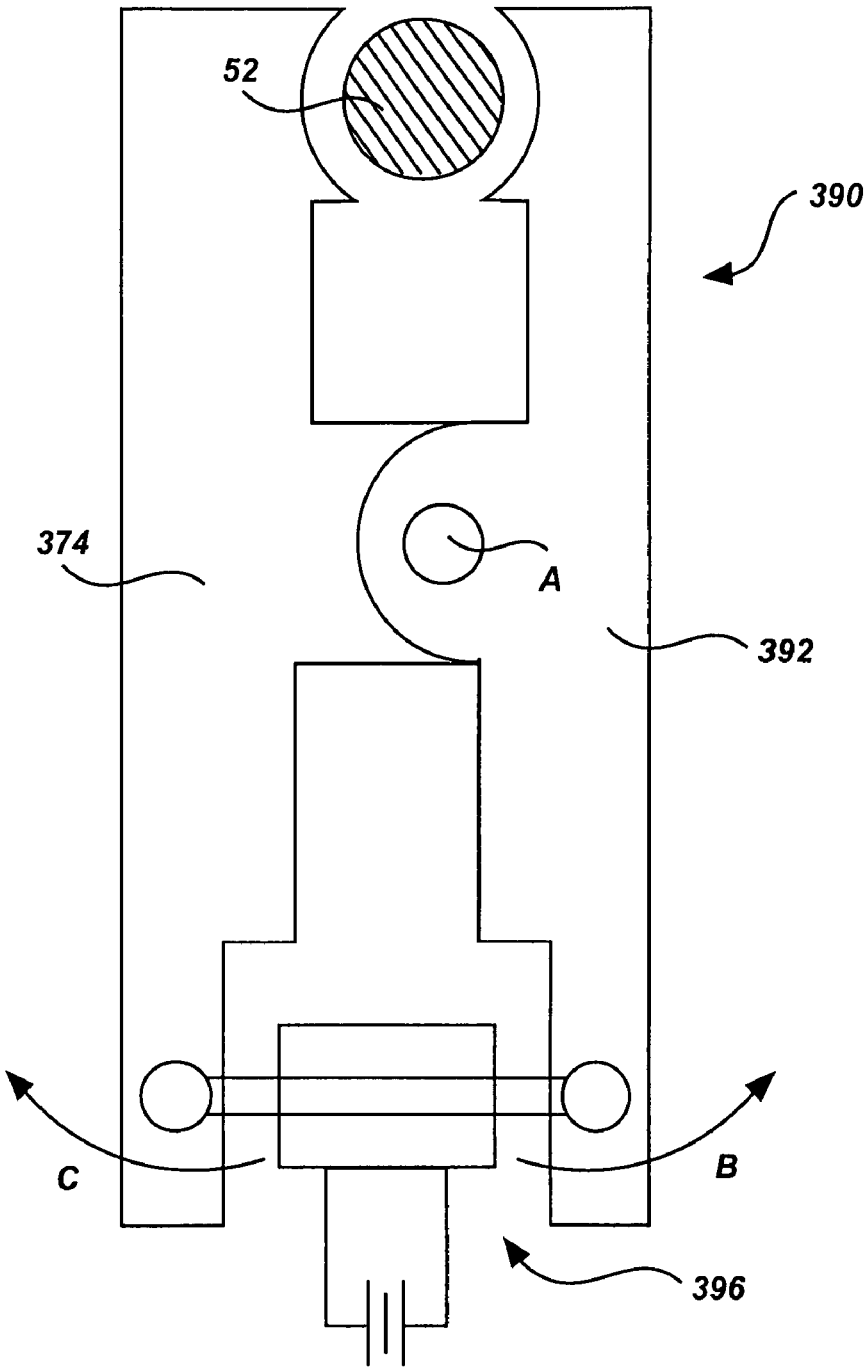
FIG. 32 shows a front plan view of one embodiment of a mechanical locking assembly.

In yet another embodiment of a limit mechanism, a mechanical locking assembly may be used to prevent undesired rotation of platform axles 52, 54, 152, 154. FIG. 32 shows a front plan view of one embodiment of a mechanical locking assembly 390. Mechanical locking assembly 390 may comprise a first locking jaw 392 and a second locking jaw 394 pinned or otherwise rotatively coupled about point A. An electrical relay 396 may be used to control the rotation of first locking jaw 392 and second locking jaw 394 about point A, such that when electrical relay 396 is energized, first locking jaw 392 rotates in the direction of arrow B and second locking jaw 394 rotates in the direction of arrow C, causing first locking jaw 392 and second locking jaw 394 to clamp together. In this embodiment, two mechanical locking assemblies 390 may be positioned such that when relays 396 are energized, first locking jaws 392 and second locking jaws 394 clamp around platform axles 52, 54, 152, 154 to prevent all rotational motion. Moreover, electrical relay 396 may be activated by remote control, as is generally known in the art.

More than one limit mechanism may be implemented and incorporated within a lift apparatus if desired. Such a plurality of limit mechanisms may provide a desired degree of safety against unintended motion of a moveable platform. Thus, at least one limit mechanism may allow for operation of a lift apparatus without danger of unintended movement of the moveable platform due to the force of earthly gravity.

Further, the lift may be remotely operated by a cable or similar member connected to the ratchet mechanism 370, which extends out from the lift, for example, to attach near the top of an incline to be traversed by the wheelchair occupant. This allows a user at a higher elevation to access the lift even when the lift is in a lowered position. The cable or other remote control mechanism may be used to raise the lift to the upper position without the wheelchair occupant being positioned within the lift.

Accordingly, in use, a lift system may be positioned near one or more steps, or another area of raised elevation. A wheelchair occupant may move the wheelchair into the lift apparatus and may position the wheelchair on at least one roller of a moveable platform assembly of the lift apparatus. With the wheelchair positioned on the at least one roller, the user moves at least one wheel of the wheelchair (e.g., rotates the at least one wheel as ordinarily done for traversing a substantially horizontal or inclined surface). In one embodiment, a user may apply substantially the same force to the at least one wheel as is required to traverse a substantially horizontal surface. As explained above, a transmission connects the moveable platform assembly to a support frame that may include at least one substantially vertical column, in one embodiment. The transmission causes the moveable platform assembly to move generally upward relative to the support frame, thereby causing the wheelchair to raise above a ground surface. As the wheelchair and the moveable platform assembly raise, the ramp connected to the support also raises. A ratchet assembly may be employed for preventing the moveable platform assembly from falling to the ground as the user moves the wheels to raise the lift. When the moveable platform assembly reaches a selected height (e.g., when the ramp is substantially horizontal), the user may exit the lift and roll onto the ramp (for example, by pushing or pulling on the support frame to urge the wheels off of the rollers). The user then proceeds across the ramp by moving the wheels of the wheelchair. Of course, to return to the lower ground surface, the user may proceed across the ramp and enter the lift apparatus. The user deactivates the ratchet assembly to allow the moveable platform to lower the wheelchair toward the lower ground surface. When the moveable platform is suitably positioned, the user may then exit the lift apparatus.

Figure 22:
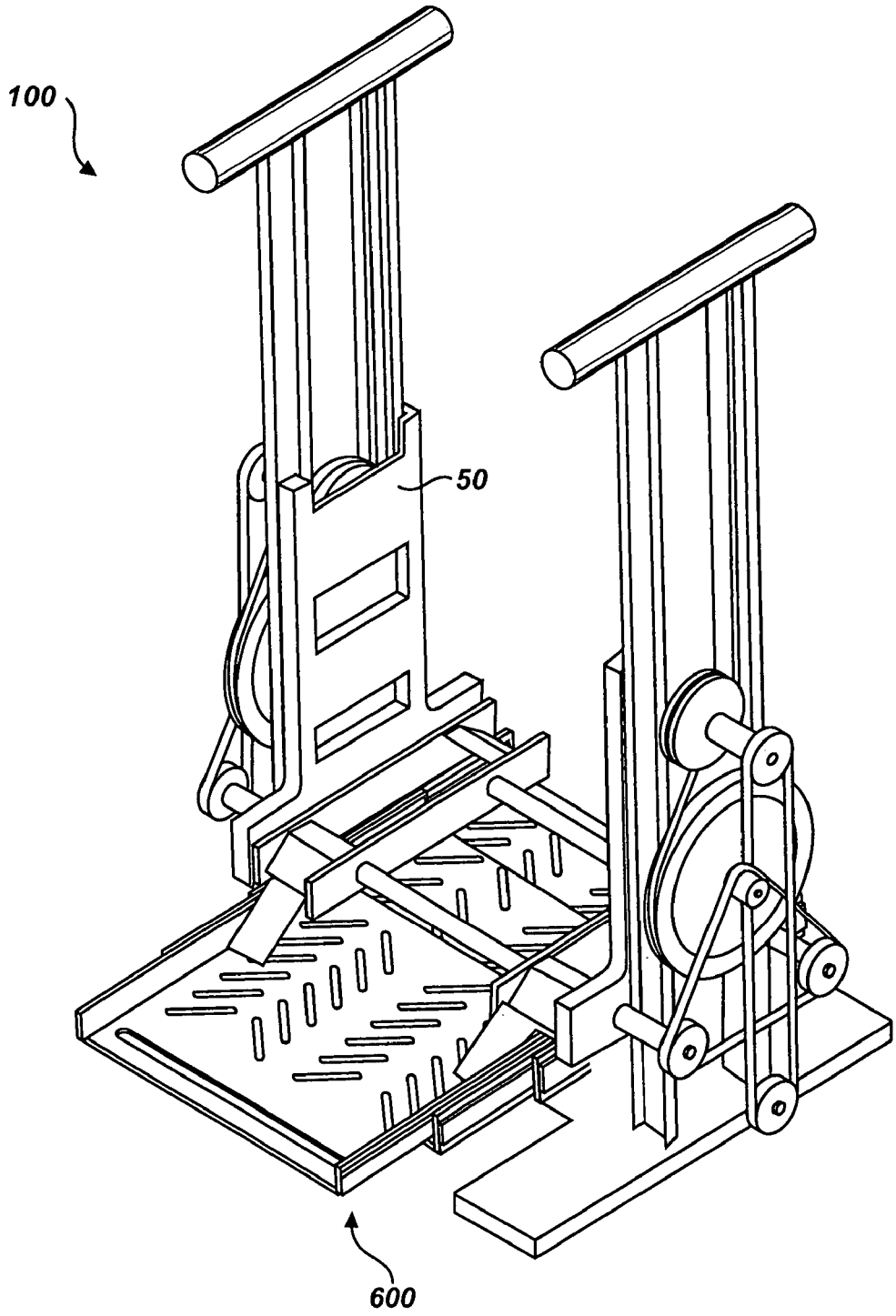
FIG. 22 shows a front perspective view of one embodiment of a telescoping platform operably connected with a lift apparatus.

FIG. 22 shows a front perspective view of one embodiment of a platform 600 that may be used in connection with lift apparatus 100, 101 discussed above. Generally, platform 600 is a telescoping platform that may be fixably attached to the bottom of moveable platform 50, 150 of lift apparatus 100, 101, discussed above. As moveable platform 50, 150 raises, platform 600 also raises. Once moveable platform has reached a desired vertical height, platform 600 may be extended laterally to span a horizontal distance between lift apparatus 100, 101 and an elevated destination, as explained in further detail below.

Figure 23:
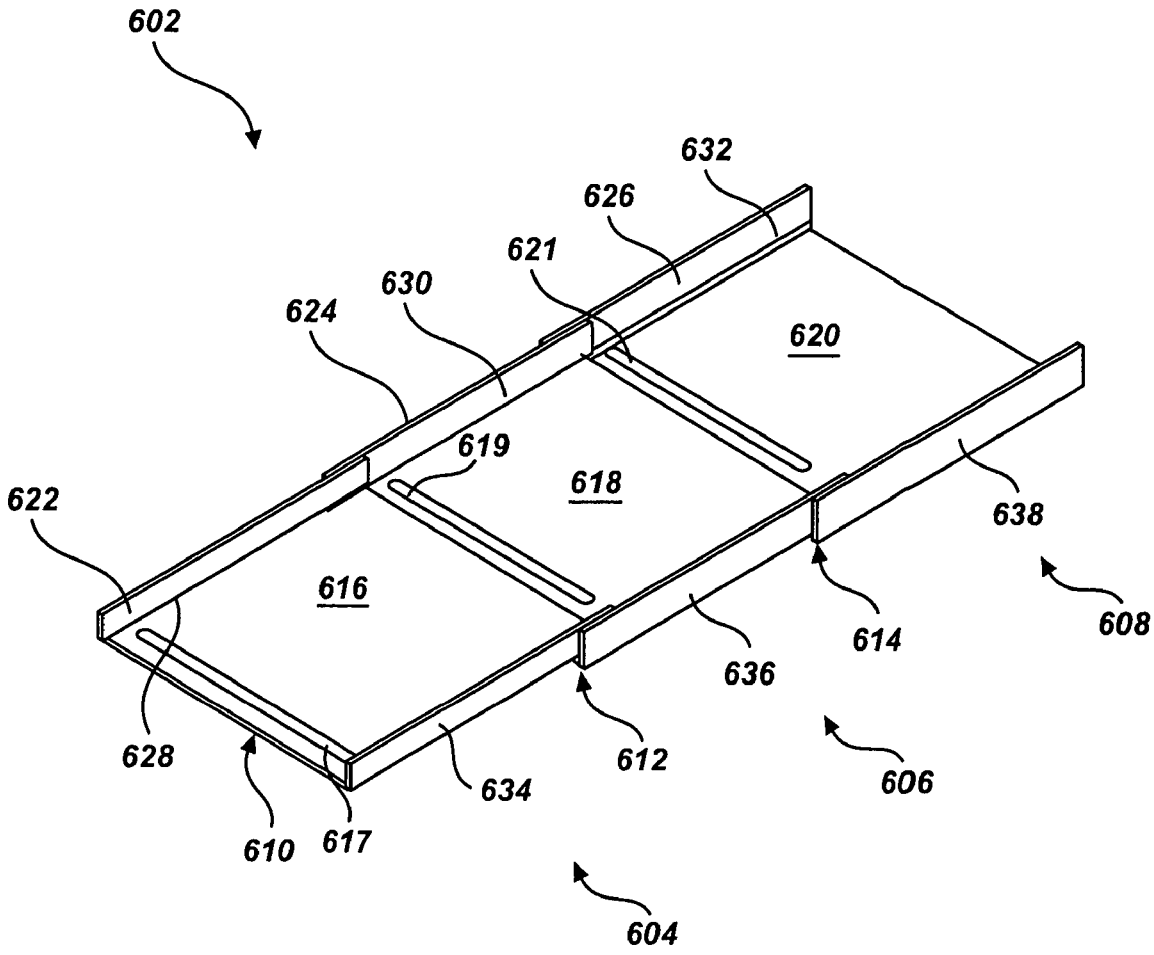
FIG. 23 shows a front perspective view of one embodiment of a plate assembly in the extended position.
Figure 24:
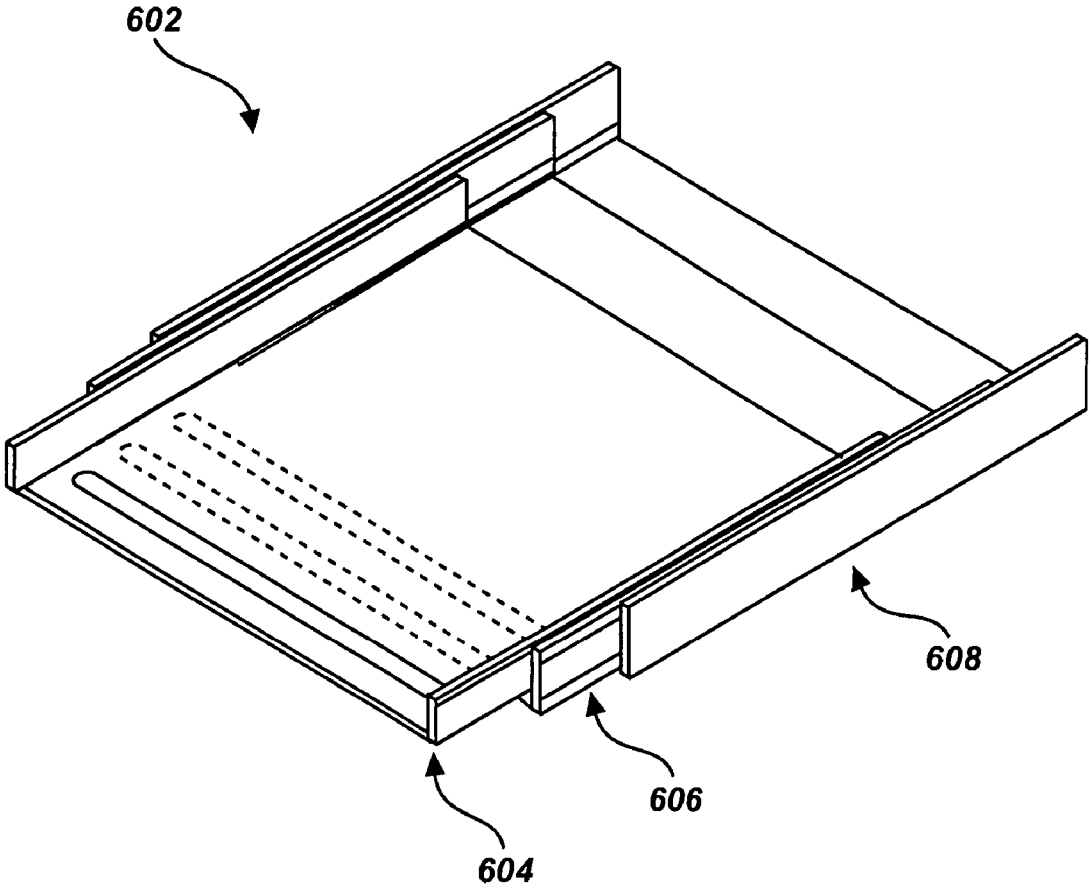
FIG. 24 shows a front perspective view of the plate assembly shown in FIG. 23 in the retracted position.

FIGS. 23 and 24 show front perspective views of one embodiment of a plate assembly 602 in the extended and retracted positions, respectively. In this embodiment, plate assembly 602 may comprise a plurality of nested plates 604, 606, 608 that vary in breadth and width to accommodate clearance for movement. Plates 604, 606, 608 may be sand casted of titanium or aluminum, or any other material with a comparable strength to weight ratio as is generally known in the art. Also, one of ordinary skill in the art will readily understand that the present invention contemplates more or fewer plates. Three plates 604, 606, 608 are shown in this embodiment for discussion and illustration only.

Each of plates 604, 606, 608 may comprise, respectively, a bottom surface 610, 612, 614, a top surface 616, 618, 620, and lip portions 622, 624, 626 rising from the sides of bottom surface 610, 612, 614. Lip portions 622, 624, 626 may comprise inner surfaces 628, 630, 632 and outer surfaces 634, 636, 638. In addition, plates 604, 606, 608 may feature cylindrical slots 617, 619, 621 that facilitate the transfer of horizontal force from the drive assembly (not shown) and the extension assembly (not shown) discussed below.

Figure 33:
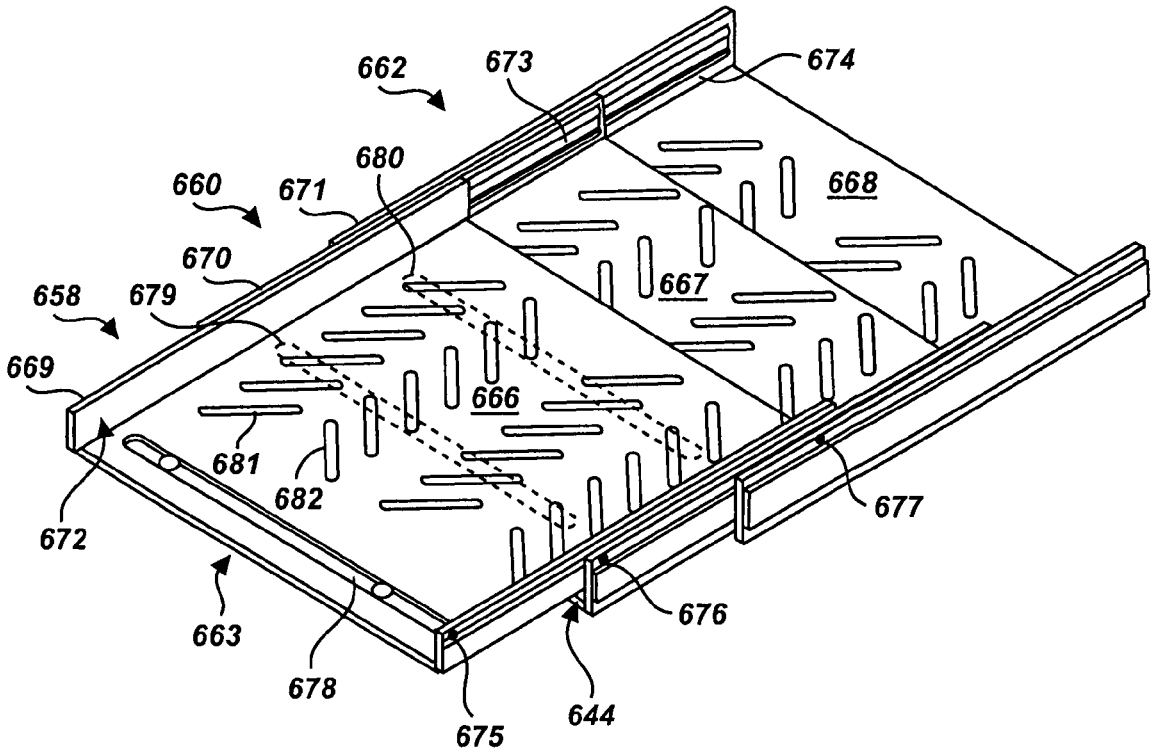
FIG. 33 shows a front perspective view of another embodiment of nested plates for use in connection with the plate assembly shown in FIGS. 23 and 24.

FIG. 33 shows a front perspective view of another embodiment of nested plates 658, 660, 662 for use in connection with plate assembly 602. Each of plates 658, 660, 662 may comprise, respectively, a bottom surface 663, 664, 665, a top surface 666, 667, 668, and lip portions 669, 670, 671 rising from the sides of bottom surface 663, 664, 665. Lip portions 669, 670, 671 may comprise inner surfaces 672, 673, 674 and outer surfaces 675, 676, 677. In addition, plates 658, 660, 662 may feature cylindrical slots 678, 679, 680 that facilitate the transfer of horizontal force from the drive assembly (not shown) and the extension assembly (not shown) discussed below. In this embodiment, each of nested plates 658, 660, 662 may feature a series of angled slots 681, 682 that create friction between the wheels of the wheelchair and plates 658, 660, 662 and reduce the weight of nested plates 658, 660, 662. Angled slots 681, 682 may be equally spaced at opposing 45 degree angles, respectively, and may be formed using a metal stamping procedure.

Figure 25:
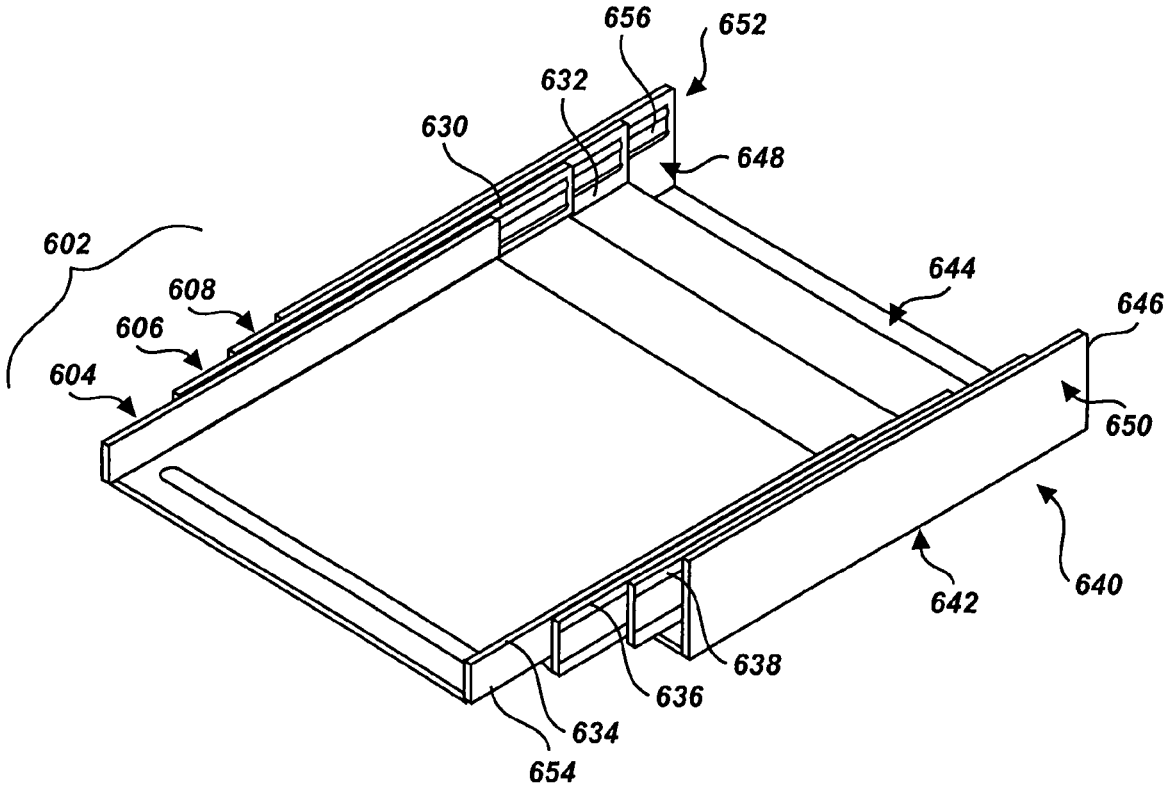
FIG. 25 shows a front perspective view of the plate assembly shown in FIGS. 23 and 24 coupled to a housing.

FIG. 25 shows a front perspective view of one embodiment of plate assembly 602 coupled to a housing 640. Plates 604, 606, 608 (or 658, 660, 662 in FIG. 33) may be compressed within housing 640 or extended to provide a planar surface for wheelchair ingress and egress from the lift apparatus. Housing 640 may shelter plate assembly 602 and provide an interface between moveable platform 50, 150 (not shown) and plate assembly 602. Housing 640 may comprise a bottom surface 642, a top surface 644, and lip portions 646 rising from the sides of bottom surface 642. Lip portions 646 may comprise inner surfaces 648 and outer surfaces 650. Housing 640 may be fixedly attached to moveable platform 50, 150 (not shown) such that plate assembly 602 rises vertically with the moveable platform. Housing 640 may be attached by welding, fastening elements (e.g., pins, threaded bolts or screws, etc.), or as otherwise known in the art.

In one embodiment, plates 604, 606, 608 (or 658, 660, 662 in FIG. 33) may be slidably coupled to housing 640 through a plurality of channel assemblies 652 that allow plates 604, 606, 608 (or 658, 660, 662 in FIG. 33) to move laterally relative to each other. Each channel assembly 652 may comprise a slider 654 and a casing 656. Sliders 654 may be fixably attached to outer surfaces 634, 636, 638 (or 675, 676, 677 in FIG. 33), and casings 656 may be fixably attached to inner surfaces 630, 632, 648 (or 673, 674 in FIG. 33) by welding, fastening elements (e.g., pins, threaded bolts or screws, etc.), or as otherwise known in the art. Mating sliders 654 with casings 656 allows plates 604, 606, 608 (or 658, 660, 662 in FIG. 33) to extend laterally from housing 640 upon the application of a horizontal force. Further, the present invention contemplates other means for attaching plate assembly 602 to moveable platform 50, 150. For example, a plurality of L-shaped brackets could be used in place of housing 640.

Figure 26:
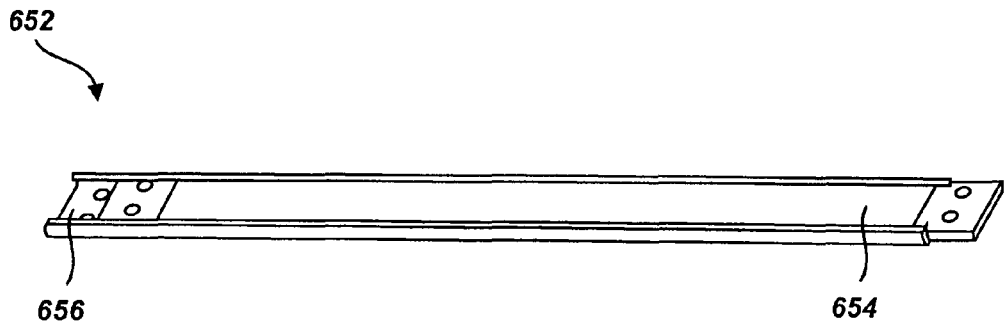
FIG. 26 shows a front perspective view of one embodiment of a channel assembly.

FIG. 26 shows a front perspective view of one embodiment of an example channel assembly 652, including a mated slider 654 and casing 656. In general, a channel assembly, as used herein, encompasses a broad array of sliding or gliding mechanisms that may be used to facilitate lateral movement of nested plates 604, 606, 608 in the embodiment of FIG. 25 (or 658, 660, 662 in the embodiment of FIG. 33). In addition, one of ordinary skill in the art will readily understand that other embodiments may use more or fewer channel assemblies as required by the number of plates.

Figure 27:
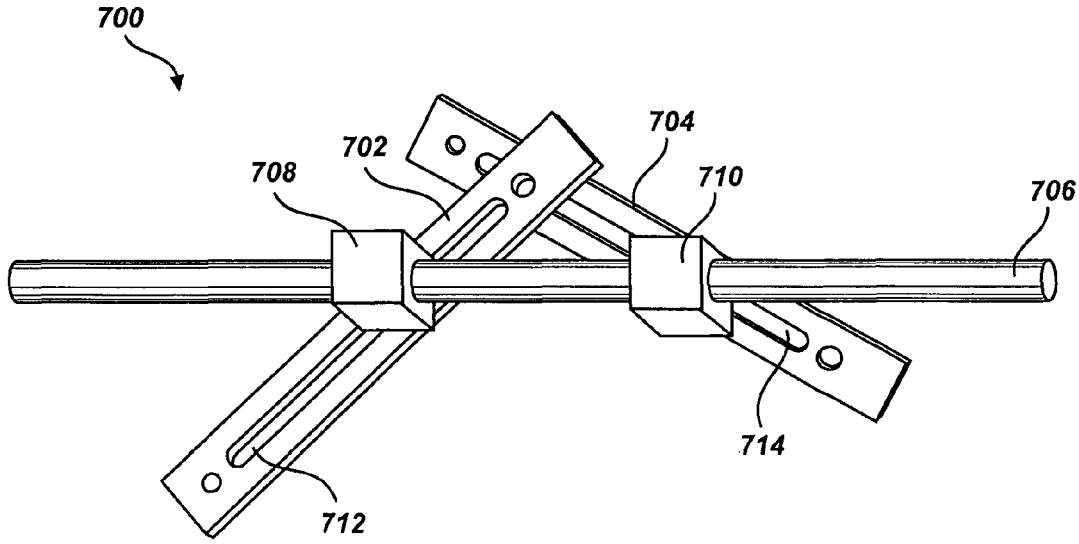
FIG. 27 shows a front perspective view of one embodiment of a drive assembly.

FIG. 27 shows a front perspective view of one embodiment of a drive assembly 700, which drives the expansion of the nested plates 604, 606, 608 (or 658, 660, 662 in the embodiment of FIG. 33). In this embodiment, drive assembly 700 may comprise two drive flanges 702, 704, a drive rod 706, and two internally threaded drive blocks 708, 710. Drive flanges 702, 704 may be coupled with drive rod 706 by means of drive blocks 708, 710. In further detail, drive blocks 708, 710 may be threaded onto drive rod 706 and slidably coupled with centered cylindrical slots 712, 714 in drive flanges 702, 704 by fastening elements (e.g., pins, threaded bolts or screws, etc.), or as otherwise known in the art. Drive rod 706 may be threaded in both directions, such that rotating drive rod 706 in one direction causes drive blocks 708, 710 to move outward, forcing drive flanges 702, 704 to a horizontal position. Rotating drive rod 706 in the opposite direction causes drive blocks 708, 710 to move inward, forcing drive flanges 702, 704 together to obtain the desired horizontal distance.

Figure 28:
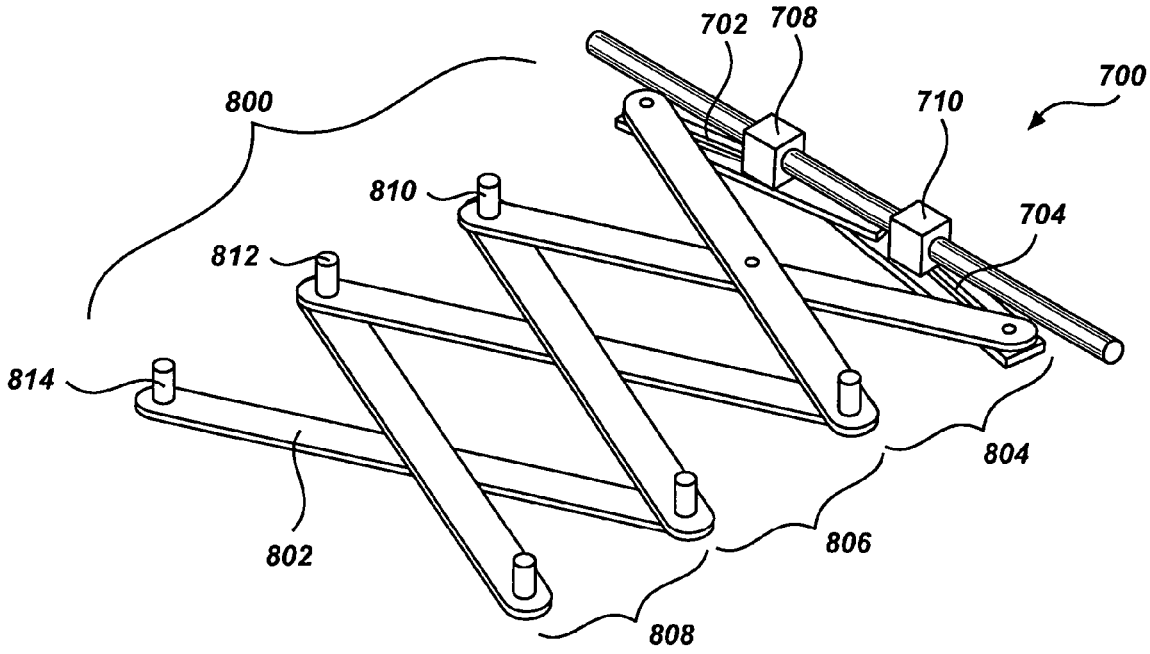
FIG. 28 shows a front perspective view of one embodiment of an extension assembly.

FIG. 28 illustrates a front perspective view of one embodiment of an extension assembly 800 as connected to drive assembly 700, discussed above. In this embodiment, extension assembly 800 may comprise a plurality of extension flanges 802, crossed and pivotally coupled in the centers so as to form a number of scissor jacks 804, 806, 808. The first scissor jack 804 may be pivotally coupled to drive flanges 702, 704, such that force transmitted from drive assembly 700 is translated through extension assembly 800. These pivoting joints may be pinned, bolted, riveted, joined by rotational fasteners, or otherwise rotatively connected as is known in the art. Drive pins 810, 812, 814 may be used to pivotally connect scissor jacks 804, 806, 808 in serial and to operatively connect scissor jacks 804, 806, 808 to plates 604, 606, 608; 658, 660, 662 (FIGS. 23, 33) through cylindrical slots 617, 619, 621; 678, 679, 680 (FIGS. 23, 33).

Figure 34:
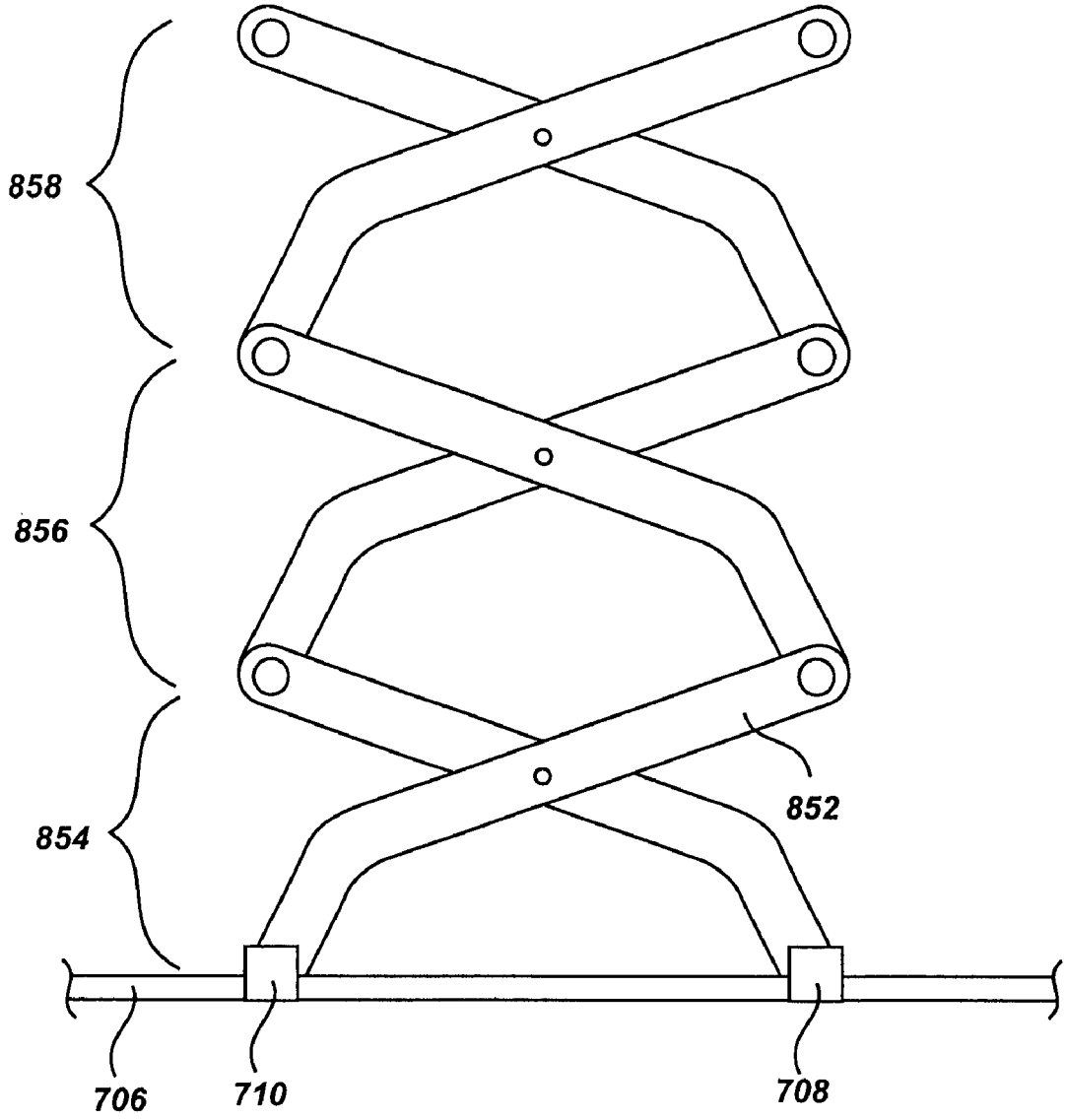
FIG. 34 shows a top plan view of another embodiment of the scissor jacks shown in FIG. 28 operably coupled with the drive rod and drive blocks shown in FIG. 27.

FIG. 34 shows a top plan view of another embodiment of scissor jacks 854, 856, 858 operably coupled with drive rod 706 and drive blocks 708, 710. In this embodiment a plurality of extension flanges 852 may be crossed and pivotally coupled in the centers so as to form a number of scissor jacks 854, 856, 858. Extension flanges 852 may be angled at approximately 55 degrees, which redistributes the load from a wheelchair and occupant over the full travel of plate assembly 602 (not shown). As shown in FIG. 34, the first scissor jack 854 may be fixably coupled directly to drive blocks 708, 710, eliminating the need for drive flanges 702, 704, discussed above. Optionally and alternately, scissor jacks 854, 856, 858 may be pivotally connected to each other and to nested plates 604, 606, 608; 658, 660, 662 (FIGS. 23, 33) through shoulder bolts, rivets, other rotational fasteners, or any combination thereof as is generally known in the art To reduce the friction at each rotational joint, fasteners may be coated or fitted with a sleeve formed of polymer resin or TEFLON®, or any other suitable material with a comparable friction coefficient.

To withstand the downward forces produced by plate assembly 602 and a wheelchair and occupant, drive flanges 702, 704, drive blocks 708, 710, extension flanges 802, 852, drive pins 810, 812, 814, and any rotational fasteners may be formed of steel, titanium, aluminum, or any other material of suitable strength. In one embodiment, drive flanges 702, 704 and drive blocks 708, 710 may be machined or sand casted.

Figure 29:
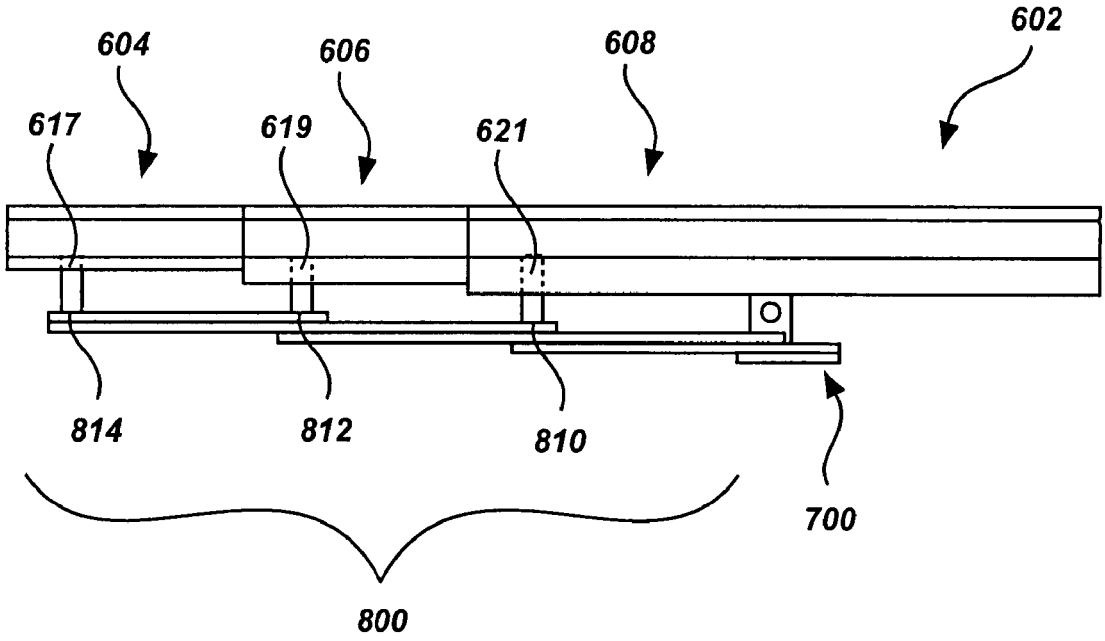
FIG. 29 shows a side plan view of one embodiment of the plate assembly shown in FIGS. 23 and 24 coupled with the drive assembly shown in FIG. 27 and the extension assembly shown in FIG. 28.

FIG. 29 shows a side plan view of one embodiment of plate assembly 602, drive assembly 700, and extension assembly 800 coupled together. As illustrated in FIG. 29, drive pins

810, 812, 814, or any other suitable rotational fasteners, may be sized such that when mated with plate assembly 602, they extend through corresponding cylindrical slots 617, 619, 621 (or 678, 679, 680 in FIG. 33) in plates 604, 606, 608 (or 658, 660, 662 in FIG. 33). In this configuration, horizontal force exerted by drive assembly 700 translates through scissor jacks 804, 806, 808 (or 854, 586, 858 in FIG. 34) and plates 604, 606, 608 (or 658, 660, 662 in FIG. 33) causing plates 604, 606, 608 (or 658, 660, 662 in FIG. 33) to move the desired horizontal distance.

Figure 30:
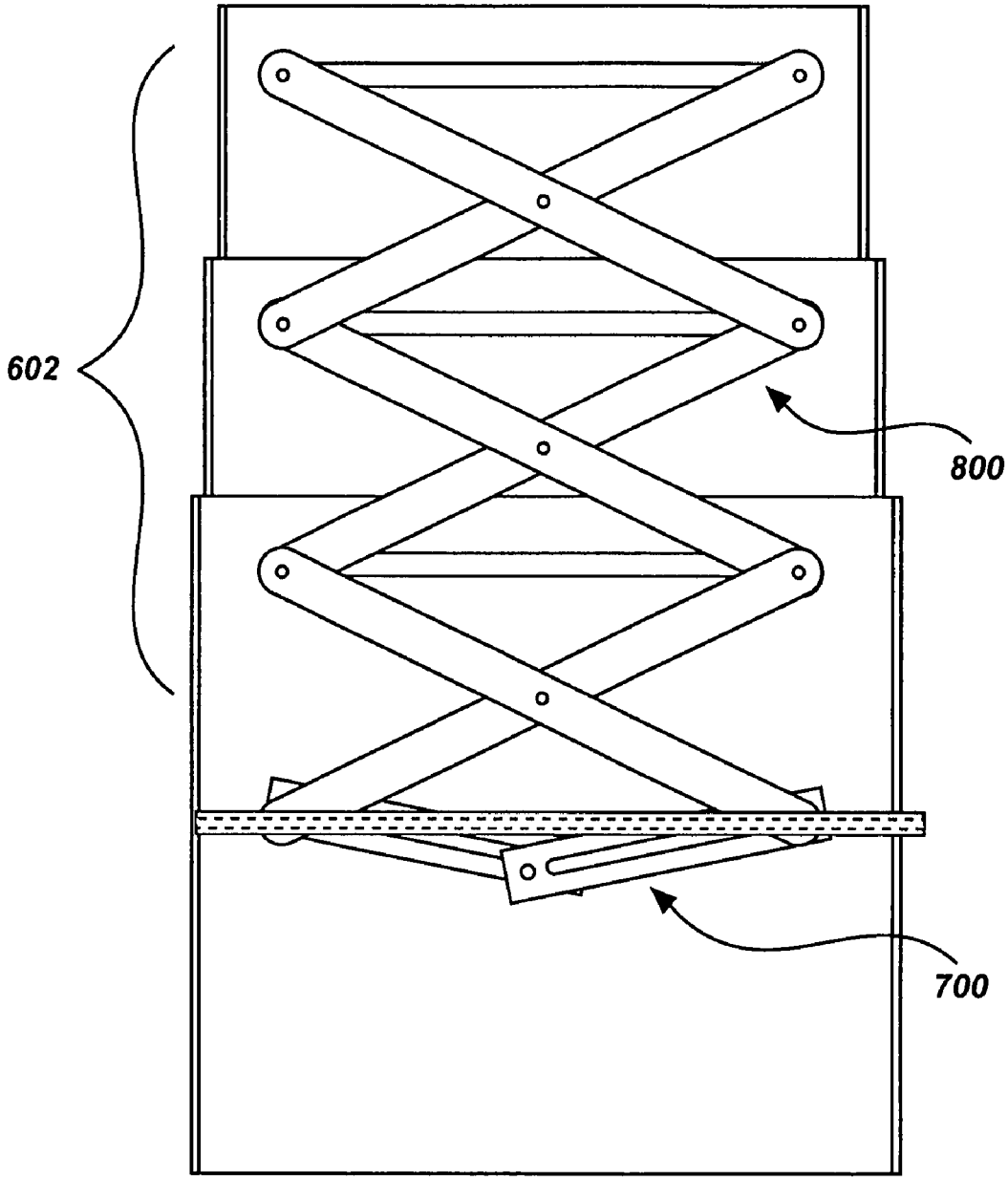
FIG. 30. shows a bottom plan view of one embodiment of the plate assembly shown in FIGS. 23 and 24 coupled with the drive assembly shown in FIG. 27 and the extension assembly shown in FIG. 28.

FIG. 30 shows a bottom plan view of the same embodiment of plate assembly 602, drive assembly 700, and extension assembly 800 operably coupled together.

Generally, the present invention contemplates that platform 600 may be operably coupled to moveable platform 50, 150 (FIGS. 2, 12). As discussed above, one embodiment of moveable platform 50, 150 (FIGS. 2, 12) may include rollers 56, 57, 58, 59; 156, 157, 158, 159 (FIGS. 3, 13). Such rollers may be positioned generally within wheel recesses 66, 68; 166, 168 (FIGS. 2, 12) and may be structured for supporting a wide variety of wheelchair wheel shapes and sizes. A wheelchair may be moved over moveable platform 50, 150 (FIGS. 2, 12) until a portion of at least one wheel of the wheelchair contacts or otherwise interacts with at least one roller positioned generally within at least one of wheel recesses 66, 68; 166, 168 (FIGS. 2, 12). In one embodiment, a transmission, gearbox, worm gear, belt or pulley system, or other method of power transmission generally known in the art, may be structured to rotate drive rod 706 in response to a torque applied to at least one wheelchair wheel which is substantially equal to, or less than, a torque required to move the wheelchair across a substantially horizontal surface. Thus, rotation of at least one wheel of the wheelchair contacting the at least one roller may cause platform 600 to move laterally relative to the lift apparatus, allowing a wheelchair passenger to enter and exit the lift apparatus. A clutch or other suitable mechanism for engaging and disengaging rotational motion may select vertical motion of moveable platform 50, 150, horizontal motion of platform 600, both, or neither.

Figure 35:
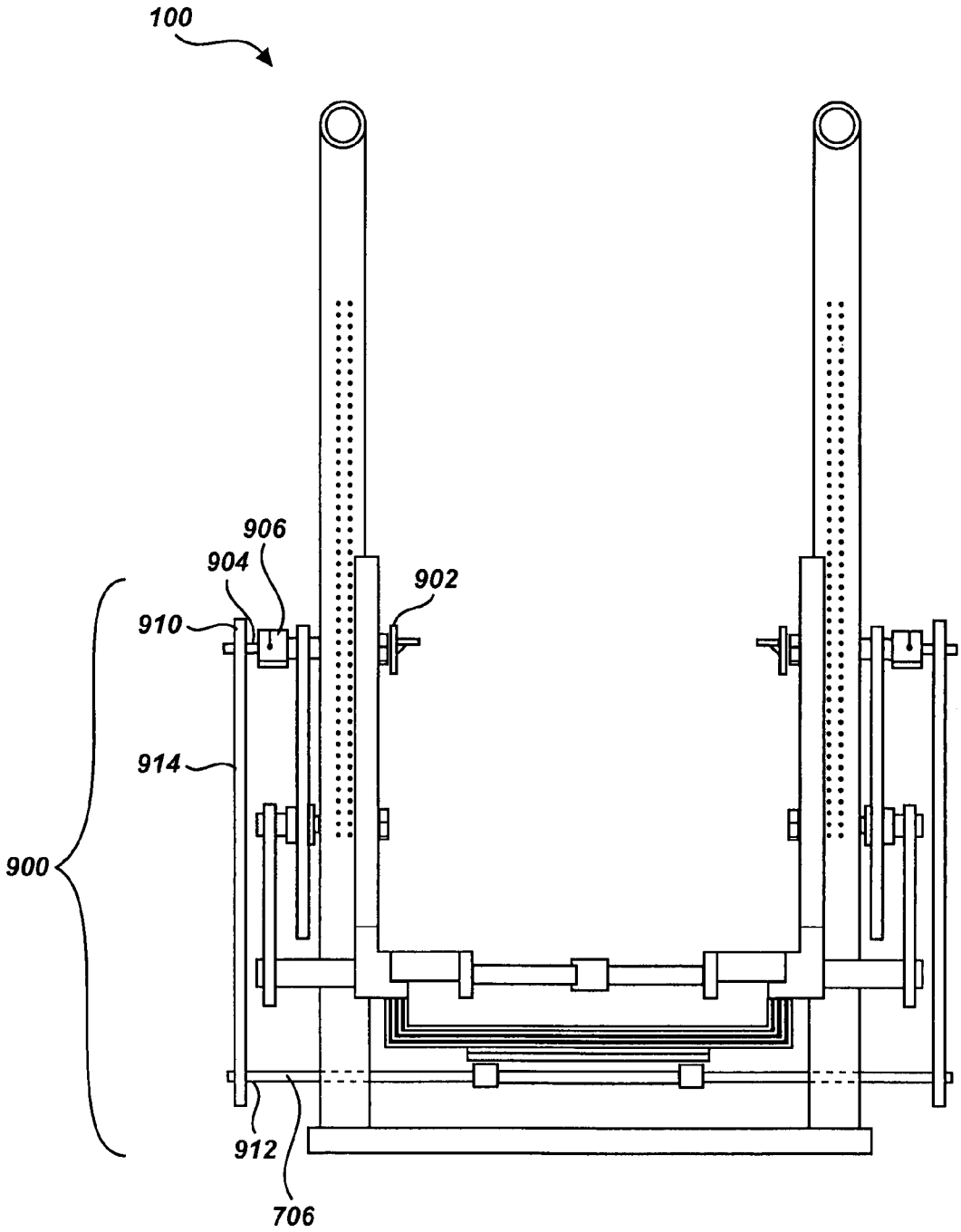
FIG. 35 shows a front plan view of one embodiment of the lift apparatus equipped with a hand crank system.

FIG. 35 shows a front plan view of one embodiment of lift apparatus 100 equipped with a hand crank system 900. Generally, hand crank system 900 allows a wheelchair occupant to manually extend telescoping platform in a lateral direction by rotating a hand crank. In one embodiment, hand crank system 900 may comprise a handle 902, a handle shaft 904, a modified sprocket shaft 906, a handle pulley 910, a platform pulley 912, and a platform drive belt 914. In this embodiment, handle 902 may be fixably connected to handle shaft 904, which may extend through a channel (not shown) bored through modified sprocket shaft 906 to fixably couple with handle pulley 910. Modified sprocket shaft may be equipped with an internal roller bearing 908 (not shown) to facilitate frictionless rotation. In addition, drive rod 706 may be fixably coupled with platform pulley 912, which in turn may be coupled to handle pulley 910 through drive belt 914. Handle pulley 910 and platform pulley 912 may be so-called "pinion pulleys" and may include teeth (not shown) arranged generally about the circumference of each pulley, respectively. In addition, platform drive belt 914 may include a series of teeth and grooves that are spaced to mesh with handle pulley 910 and platform pulley 912. Accordingly, rotation of handle 902 in either direction is translated through handle pulley 910, platform drive belt 914, and platform pulley 912 to drive rod 706, which powers drive assembly 700 and causes platform 600 to move laterally relative to lift apparatus 100, 101. Hand crank system 900 may be located on the left side of lift apparatus 100, 101, the right side of lift apparatus 100, 101, or both.

Figure 36:
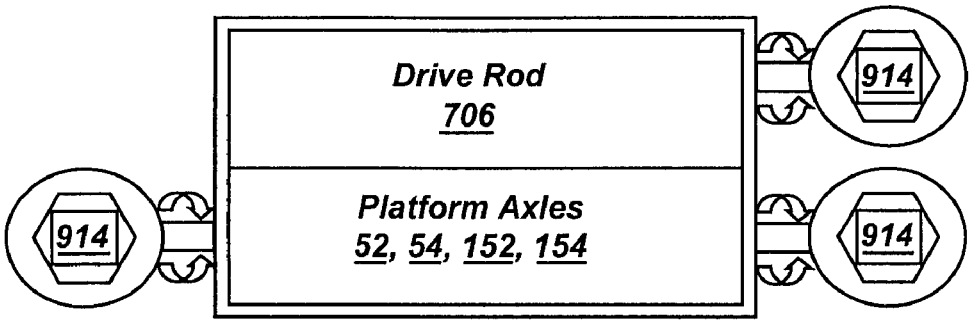
FIG. 36 shows a functional block diagram of one embodiment of an automated lift apparatus.

Optionally, the present invention further contemplates that in one embodiment, the vertical movement of lift apparatus 100, 101 and/or the lateral movement of platform 600 may be automated. FIG. 36 shows a functional block diagram of one embodiment of an automated lift apparatus. In this embodiment, three-phase induction motors 914 capable of clockwise and counterclockwise rotation may be structured to independently rotate platform axles 52, 54; 152, 154 and/or drive rod 706, noting that the use of motors to drive mechanical assemblies is generally known in the art. In addition, external motor controls may be located such that lift apparatus 100, 101 and/or platform 600 may be operated remotely.

Figure 37:
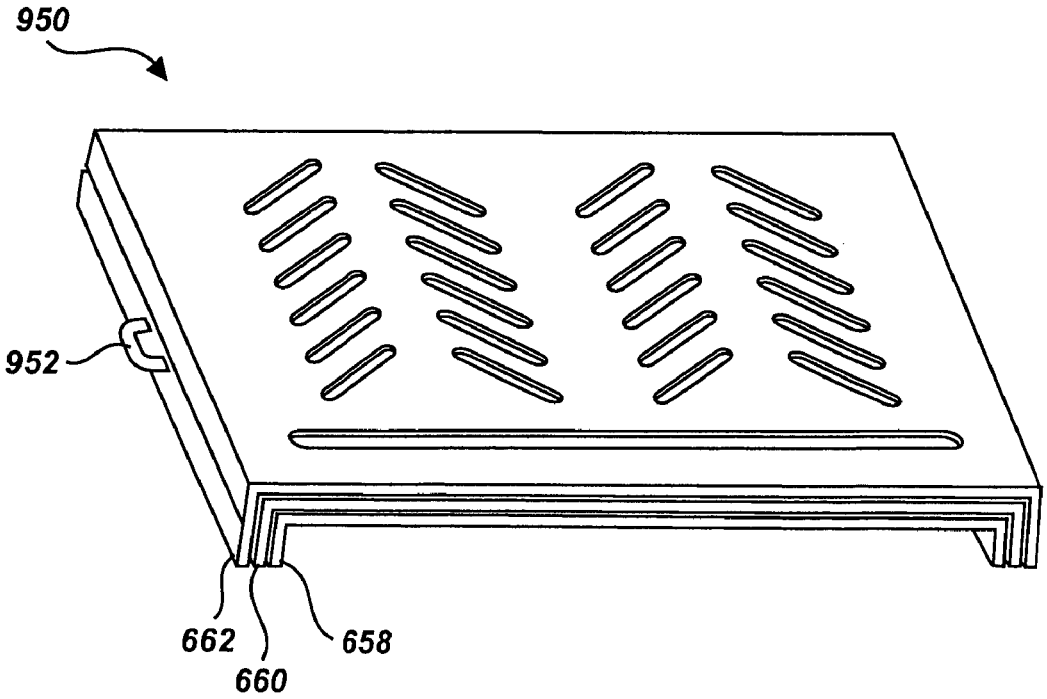
FIG. 37 shows one embodiment of a portable telescoping platform in the fully collapsed position.
Figure 38:
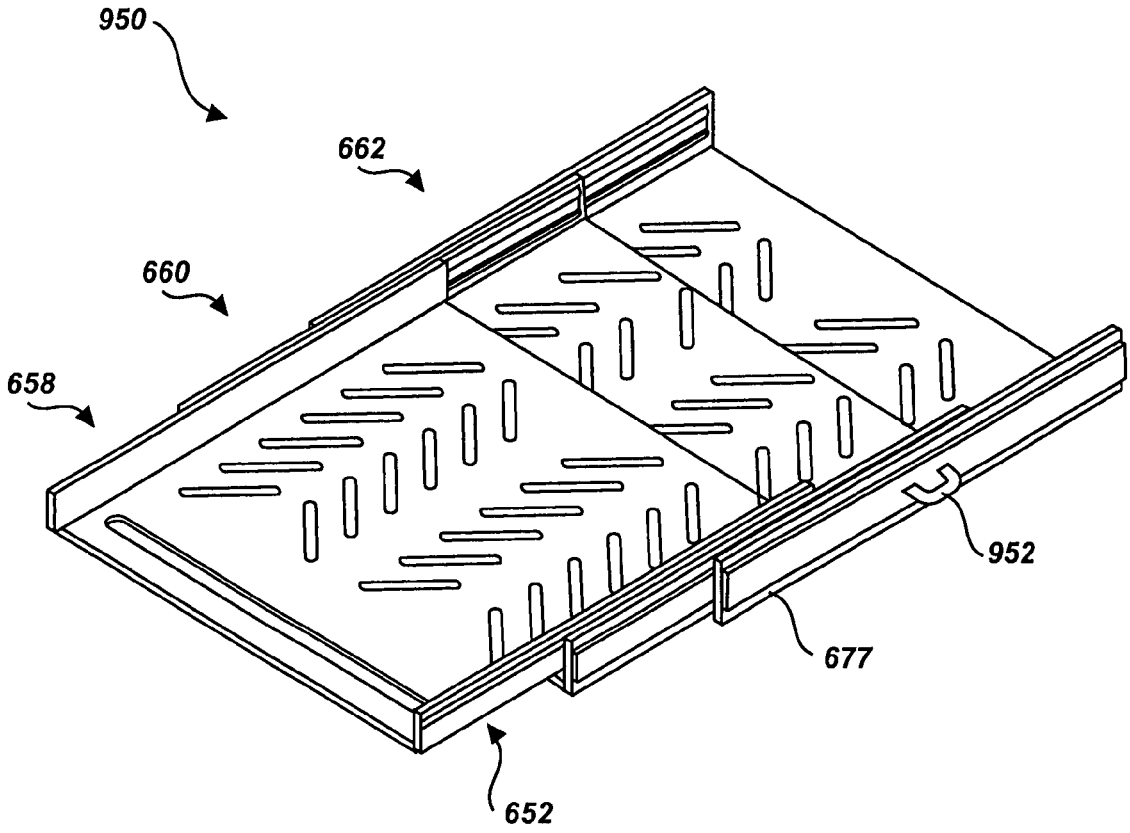
FIG. 38 shows one embodiment of a portable telescoping platform in the fully extended position.

The present invention further contemplates that platform 600 may be used independently as a portable telescoping platform 950. FIGS. 37 and 38 show one embodiment of portable telescoping platform 950 in the fully collapsed and fully extended positions, respectively. In this embodiment, portable telescoping platform 950 may comprise nested plates 604, 606, 608; 658, 660, 662 (FIGS. 23, 33) slidably coupled through channel assembly 652. In addition, in this embodiment, a handle 952 may be fixably attached to outer surface 638, 677 of plate 608, 662, such that when in the fully collapsed position, portable platform assembly 950 may be manually transported.

One skilled in the art will appreciate that the present invention can be practiced by other than the described embodiments, which are presented for purposes of illustration and not of limitation, and the present invention is limited only by the claims which follow. Put another way, while certain embodiments and details have been included herein for purposes of illustrating the invention, it will be apparent to those skilled in the art that various changes in the methods and apparatus disclosed herein may be made without departing from the scope of the invention, which is defined in the appended claims. The words "including" and "having," as used herein including the claims, shall have the same meaning as the word "comprising."

What is claimed is:

1. A lift apparatus, comprising:

a support frame adapted to move a wheelchair in the vertical direction; and a telescoping platform connected to a moveable platform of the support frame; and wherein rotation of the at least one wheel causes the moveable platform to move in a vertical direction relative to the support frame and sized to receive and support a wheelchair and an occupant of the wheelchair;

wherein the moveable platform comprises at least one roller structured to contact at least one wheel of the wheelchair, wherein rotation of the at least one wheel causes the telescoping platform to move in a lateral direction relative to the support frame.

2. The lift apparatus of claim 1, wherein one end of the telescoping platform is fixed to the moveable platform and adapted to allow the wheelchair to roll from the moveable platform onto the telescoping platform and vice versa.

3. The lift apparatus of claim 2, wherein the fixed end of the telescoping platform travels in a vertical direction with the moveable platform, regardless of whether the telescoping platform is laterally extended.

4. The lift apparatus of claim 1, wherein the telescoping platform comprises a plurality of nested support plates.

5. The lift apparatus of claim 4, wherein each of the support plates is connected to an extension assembly.

6. The lift apparatus of claim 5, wherein the extension assembly is operated by a drive assembly.

7. The telescoping platform of claim 6, wherein the drive assembly is operated by a hand crank system.

8. The lift apparatus of claim 1, further comprising means for extending and retracting the telescoping platform across a horizontal distance to a receiving platform, regardless of the vertical height of the moveable platform, in response to rotation of at least one wheel of a wheelchair, wherein when in the extended position, the telescoping platform permits the wheelchair to traverse the horizontal distance from the moveable platform to the receiving platform.

9. The lift apparatus of claim 8, wherein a magnitude of torque applied to the at least one wheel is no more than a magnitude of torque required to roll the wheelchair upon a substantially horizontal surface.

10. The lift apparatus of claim 4, wherein each of the support plates slides laterally relative to the others through an attached channel assembly.

11. The telescoping platform of claim 4, wherein each of the nested support plates slides laterally relative to the others through attached channels.

12. The telescoping platform of claim 4, further comprising a clutch for selectively engaging and disengaging the lateral motion of the nested support plates.

13. The lift apparatus of claim 1, further comprising a clutch for selectively engaging and disengaging the vertical motion of the moveable platform and the lateral motion of the telescoping platform.

14. The lift apparatus of claim 1, further comprising a spring biasing system to counteract a load created by a wheelchair and an occupant of the wheelchair when the moveable platform moves in the vertical direction relative to the support frame.

15. The lift apparatus of claim 1, further comprising a mechanical locking assembly to selectively prevent the moveable platform from moving in a vertical direction.

16. The lift apparatus of claim 1, wherein the moveable platform moves vertically in response to a torque applied to the wheel, wherein the torque has a magnitude that does not exceed a magnitude of torque required to roll the wheelchair upon a substantially horizontal surface.

17. The lift apparatus of claim 1, further comprising at least one induction motor to automate the vertical motion of the moveable platform.

18. The lift apparatus of claim 1, further comprising at least one induction motor to automate the horizontal motion of the telescoping platform.

19. The lift apparatus of claim 1, further comprising at least one hand crank system to manually extend the telescoping platform in a lateral direction relative to the support frame.

20. The lift apparatus of claim 1, wherein the moveable platform has at least one wheel recess to guide at least one wheelchair wheel and retain the wheelchair inside the support frame.

* * * * *

UNITED STATES PATENT AND TRADEMARK OFFICE

CERTIFICATE OF CORRECTION

PATENT NO. : 7,954,602 B2
APPLICATION NO. : 11/778169
DATED : June 7, 2011
INVENTOR(S) : Joseph Stanislao It is certified that error appears in the above-identified patent and that said Letters Patent is hereby corrected as shown below:

Column 16, Lines 41-55, Claim 1 should read as follows:

A lift apparatus, comprising:
a support frame adapted to move a wheelchair in the vertical direction; and
a telescoping platform connected to a moveable platform of the support frame and sized to receive and support a wheelchair and an occupant of the wheelchair;
wherein the moveable platform comprises at least one roller structured to contact at least one wheel of the wheelchair, wherein rotation of the at least one wheel causes the telescoping platform to move in a lateral direction relative to the support frame; and
wherein rotation of the at least one wheel causes the moveable platform to move in a vertical direction relative to the support frame.

Signed and Sealed this
Twenty-fourth Day of July, 2012

David J. Kappos

David J. Kappos
*Director of the United States Patent and Trademark Office*